US011532269B2

(12) United States Patent
Lee et al.

(10) Patent No.: US 11,532,269 B2
(45) Date of Patent: Dec. 20, 2022

(54) DISPLAY SYSTEM AND DISPLAY CONTROL METHOD FOR LOW FREQUENCY DRIVING AND LOW POWER DRIVING

(71) Applicant: Samsung Electronics Co., Ltd., Suwon-si (KR)

(72) Inventors: Changju Lee, Suwon-si (KR); Yonjun Shin, Hwaseong-si (KR); Hoonmo Yang, Hwaseong-si (KR); Sungchul Yoon, Suwon-si (KR); Junghak Lee, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 17/381,788

(22) Filed: Jul. 21, 2021

(65) Prior Publication Data

US 2022/0114957 A1 Apr. 14, 2022

(30) Foreign Application Priority Data

Oct. 12, 2020 (KR) ..... 10-2020-0130886
Dec. 11, 2020 (KR) ..... 10-2020-0173549

(51) Int. Cl.
*G09G 3/3225* (2016.01)

(52) U.S. Cl.
CPC ... *G09G 3/3225* (2013.01); *G09G 2310/0243* (2013.01); *G09G 2310/0278* (2013.01); *G09G 2310/08* (2013.01); *G09G 2320/0247* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 8,854,344 | B2 * | 10/2014 | Glen | G09G 5/003 345/530 |
| 9,165,537 | B2 | 10/2015 | Wyatt et al. | |
| 9,240,031 | B1 | 1/2016 | Wang | |
| 9,355,615 | B2 * | 5/2016 | Roh | G06F 3/147 |
| 9,704,215 | B2 * | 7/2017 | Kim | G09G 5/006 |
| 10,281,999 | B2 | 5/2019 | Foss et al. | |
| 10,366,688 | B2 | 7/2019 | Gunn et al. | |
| 10,613,608 | B2 | 4/2020 | Graham et al. | |

(Continued)

*Primary Examiner* — Christopher J Kohlman
(74) *Attorney, Agent, or Firm* — Harness, Dickey & Pierce, P.L.C.

(57) ABSTRACT

A display system including a host processor and a display driver integrated circuit may be provided. The host processor may generate a clock signal that swings swinging between a high level and a low level, generate and output a first synchronization signal based on the clock signal, generate a wakeup interrupt by measuring a frame update period of a display panel, generates frame data based on the first synchronization signal by enabling an image providing path based on the wakeup interrupt, and output the frame data for every frame update period. The display driver integrated circuit may receive the first synchronization signal and the frame data from the host processor, and control the display panel such that a frame image corresponding to the frame data is displayed on the display panel based on the first synchronization signal without storing the frame data.

20 Claims, 25 Drawing Sheets

(56) References Cited

U.S. PATENT DOCUMENTS

| | | | | |
|---|---|---|---|---|
| 2015/0130822 | A1* | 5/2015 | Lee | G09G 3/20<br>345/520 |
| 2016/0042720 | A1 | 2/2016 | Chiang | |

* cited by examiner

DISPLAY SYSTEM AND DISPLAY CONTROL METHOD FOR LOW FREQUENCY DRIVING AND LOW POWER DRIVING

CROSS-REFERENCE TO RELATED APPLICATION

This application claims priority under 35 USC § 119 to Korean Patent Application No. 10-2020-0130886 filed on Oct. 12, 2020 and to Korean Patent Application No. 10-2020-0173549 filed on Dec. 11, 2020 in the Korean Intellectual Property Office (KIPO), the contents of which are herein incorporated by reference in their entirety.

BACKGROUND

1. Technical Field

Example embodiments relate generally to semiconductor integrated circuits, and more particularly to display systems for low frequency driving and low power driving and display control methods performed by the display systems.

2. Description of the Related Art

As information technology is developed, a display device becomes important to provide information to a user. Various display devices such as liquid crystal displays (LCDs), plasma displays, and electroluminescent displays have gained popularity. Among these, electroluminescent displays have quick response speeds and reduced power consumption, using light-emitting diodes (LEDs) or organic light-emitting diodes (OLEDs) that emit light through recombination of electrons and holes. Recently, display panels and display devices capable of driving with a low frequency have been researched, and various methods for driving and/or controlling the display panels and the display devices with the low frequency have been researched.

SUMMARY

At least one example embodiment of the present disclosure provides a display system capable of efficiently implementing a low frequency driving and a low power driving without a frame buffer included in a display driver integrated circuit.

At least one example embodiment of the present disclosure provides a display control method that is performed by the display system.

According to some example embodiments, a display system may include a host processor and a display driver integrated circuit. The host processor may be configured to generate a clock signal that swings swinging between a high level and a low level, generate and output a first synchronization signal based on the clock signal, generate a wakeup interrupt by measuring a frame update period of a display panel, generate frame data based on the first synchronization signal by enabling an image providing path based on the wakeup interrupt, and output the frame data for every frame update period. The display driver integrated circuit may receive the first synchronization signal and the frame data from the host processor, and control the display panel such that a frame image corresponding to the frame data is displayed on the display panel based on the first synchronization signal without storing the frame data.

According to some example embodiments, a display system may include a display driver integrated circuit and a host processor. The display driver integrated circuit may be configured to control a display panel, and generate and output a first synchronization signal. The host processor may be configured to receive the first synchronization signal from the display driver integrated circuit, generate a wakeup interrupt by measuring a frame update period of the display panel, generate frame data based on the first synchronization signal by enabling an image providing path based on the wakeup interrupt, and output the frame data for every frame update period. The display driver integrated circuit may receive the frame data from the host processor, and control the display panel such that a frame image corresponding to the frame data is displayed on the display panel based on the first synchronization signal without storing the frame data.

According to some example embodiments, a display system may include a clock source, a wakeup timer, a control/status register, a timing generator, a delay unit, an image processing unit and a video timer. The clock source may be configured to generate a clock signal that swings periodically between a high level and a low level. The wakeup timer may be configured to measure a frame update period of a display panel. The control/status register may be configured to generate a wakeup interrupt based on a measuring result from the wakeup timer. The timing generator may be configured to generate a first synchronization signal based on the clock signal to output the first synchronization signal to a display driver integrated circuit or receives a second synchronization signal from the display driver integrated circuit, and generate a first vertical synchronization signal and a first horizontal synchronization signal based on the clock signal and one of the first and second synchronization signal. The delay unit may be configured to delay the first synchronization signal or the second synchronization signal. The image processing unit may be configured to be enabled based on the wakeup interrupt, and generate frame data. The video timer may be configured to control a timing of the frame data based on the first vertical synchronization signal and the first horizontal synchronization signal, and output the frame data. The first and second synchronization signals may be output or received through a first channel, and the frame data may be output through a second channel different from the first channel. The wakeup timer, the control/status register and the timing generator may be in a first power domain that is always enabled. The image processing unit and the video timer may be in a second power domain that is different from the first power domain and may be configured to be selectively enabled based on the wakeup interrupt. The display system may be configured to selectively operate in one of a first operation mode in which the first synchronization signal is generated in the timing generator or a second operation mode in which the second synchronization signal is received from the display driver integrated circuit.

According to some example embodiments, a display control method may include generating and outputting, by a host processor, a first synchronization signal based on a clock signal that swings periodically between a high level and a low level, generating, by the host processor, a wakeup interrupt by measuring a frame update period of a display panel, generating, by the host processor, frame data based on the first synchronization signal by enabling an image providing path based on the wakeup interrupt, outputting, by the host processor, the frame data for every frame update period, receiving, by the display driver integrated circuit, the first synchronization signal and the frame data from the host processor, and controlling, by the display driver integrated circuit, the display panel such that a frame image corresponding to the frame data is displayed on the display panel based on the first synchronization signal without storing the frame data.

According to some example embodiments, a display control method may include generating and outputting, by a display driver integrated circuit, a first synchronization signal, receiving, by a host processor, the first synchronization signal from the display driver integrated circuit, generating, by the host processor, a wakeup interrupt by measuring a frame update period of a display panel, generating, by the host processor, frame data based on the first synchronization signal by enabling an image providing path based on the wakeup interrupt, outputting, by the host processor, the frame data is output for every frame update period, receiving, by the display driver integrated circuit, the frame data from the host processor, and controlling, by the display driver integrated circuit, the display panel such that a frame image corresponding to the frame data is displayed on the display panel based on the first synchronization signal without storing the frame data.

In the display system and the display control method according to some example embodiments, the display driver integrated circuit 310*a* may be implemented not to include the frame buffer. For example, the host processor may measure the frame update period of the display panel, may enable the image providing path when the frame update or panel update is desired, and may transmit a new frame to the display driver integrated circuit based on the emission time of the display panel. Further, a signal for the synchronization between the host processor and the display driver integrated circuit may be generated from one of the host processor or the display driver integrated circuit and may be provided to the other of the host processor or the display driver integrated circuit. Accordingly, the low frequency driving and the low power driving may be efficiently implemented.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
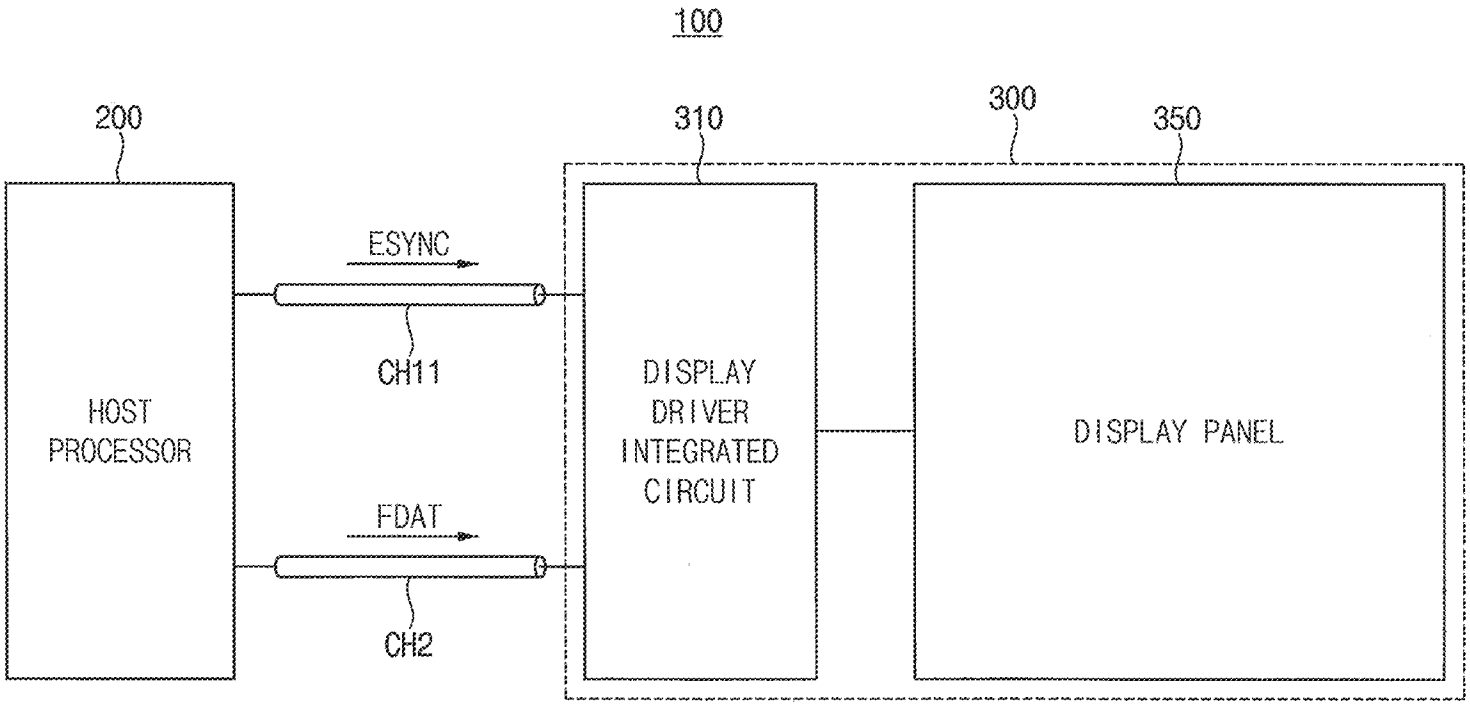
FIG. 1 is a block diagram illustrating a display system according to an example embodiment.

Various example embodiments will be described more fully with reference to the accompanying drawings, in which some example embodiments are shown. The present disclosure may, however, be embodied in many different forms and should not be construed as limited to the disclosed example embodiments set forth herein. Like reference numerals refer to like elements throughout this application.

FIG. 1 is a block diagram illustrating a display system according to an example embodiment.

Referring to FIG. 1, a display system 100 includes a host processor 200 and a display device 300. The display device 300 includes a display driver integrated (DDI) circuit 310 and a display panel 350. The display system 100 may further include a first channel CH11 and a second channel CH2.

The host processor 200 generates a clock signal that is always toggled, and generates and outputs a first synchronization signal ESYNC based on the clock signal. The host processor 200 generates a wakeup interrupt by measuring a frame update period of the display panel 350, generates frame data FDAT based on the first synchronization signal ESYNC by enabling an image providing path based on the wakeup interrupt, and outputs the frame data FDAT for every (or each) frame update period.

In some example embodiments, the host processor 200 may be implemented in the form of an application processor (AP). An example of FIG. 1 may be referred to as an AP centric interface (or a host centric interface) in which the host processor 200 generates the first synchronization signal ESYNC. Detailed configurations and operations of the host processor 200 will be described with reference to FIG. 2 and following figures.

The display driver integrated circuit 310 receives the first synchronization signal ESYNC and the frame data FDAT from the host processor 200, and controls the display panel 350 such that a frame image corresponding to the frame data FDAT is displayed on the display panel 350 based on the first synchronization signal ESYNC without storing the frame data FDAT. The display driver integrated circuit 310 may be implemented not to include a frame buffer (e.g., a graphic random access memory (GRAM)) that stores the frame data FDAT. Detailed configurations and operations of the display driver integrated circuit 310 will be described with reference to FIG. 2 and following figures.

In some example embodiments, the first synchronization signal ESYNC may be transmitted from the host processor 200 to the display driver integrated circuit 310 through the first channel CH11, and the frame data FDAT may be transmitted from the host processor 200 to the display driver integrated circuit 310 through the second channel CH2 different from the first channel CH11. In other words, the first channel CH11 for transmitting the first synchronization signal ESYNC and the second channel CH2 for transmitting the frame data FDAT may be formed individually, independently and/or separately.

In some example embodiments, the second channel CH2 may be implemented based on one of various display interface standards, e.g., one of a mobile industry processor interface (MIPI), a high definition multimedia interface (HDMI), a display port (DP), a low power display port (LPDP), or an advanced low power display port (ALPDP).

The display panel 350 may display the frame image based on or under a control of the display driver integrated circuit 310.

In some example embodiments, the display panel 350 may have relatively good (or excellent, superb, outstanding) retention characteristics. For example, the display panel 350 may be an oxide-based organic light emitting display panel. For example, the display panel 350 may maintain an image for a maximum of about one second with a single update, and thus the display panel 350 may be driven with relatively low frequency even if the display driver integrated circuit 310 does not include a frame buffer, thereby reducing the power consumption. Detailed configurations and operations of the display panel 350 and the display device 300 including the display panel 350 will be described with reference to FIG. 9 and following figures.

Hereinafter, some example embodiments will be described in detail based on an example where the second channel CH2 is implemented based on the MIPI standard. However, example embodiments are not limited thereto, and may be applied or employed to various examples where the second channel CH2 is implemented based on one of various other display interface standards.

Figure 2:
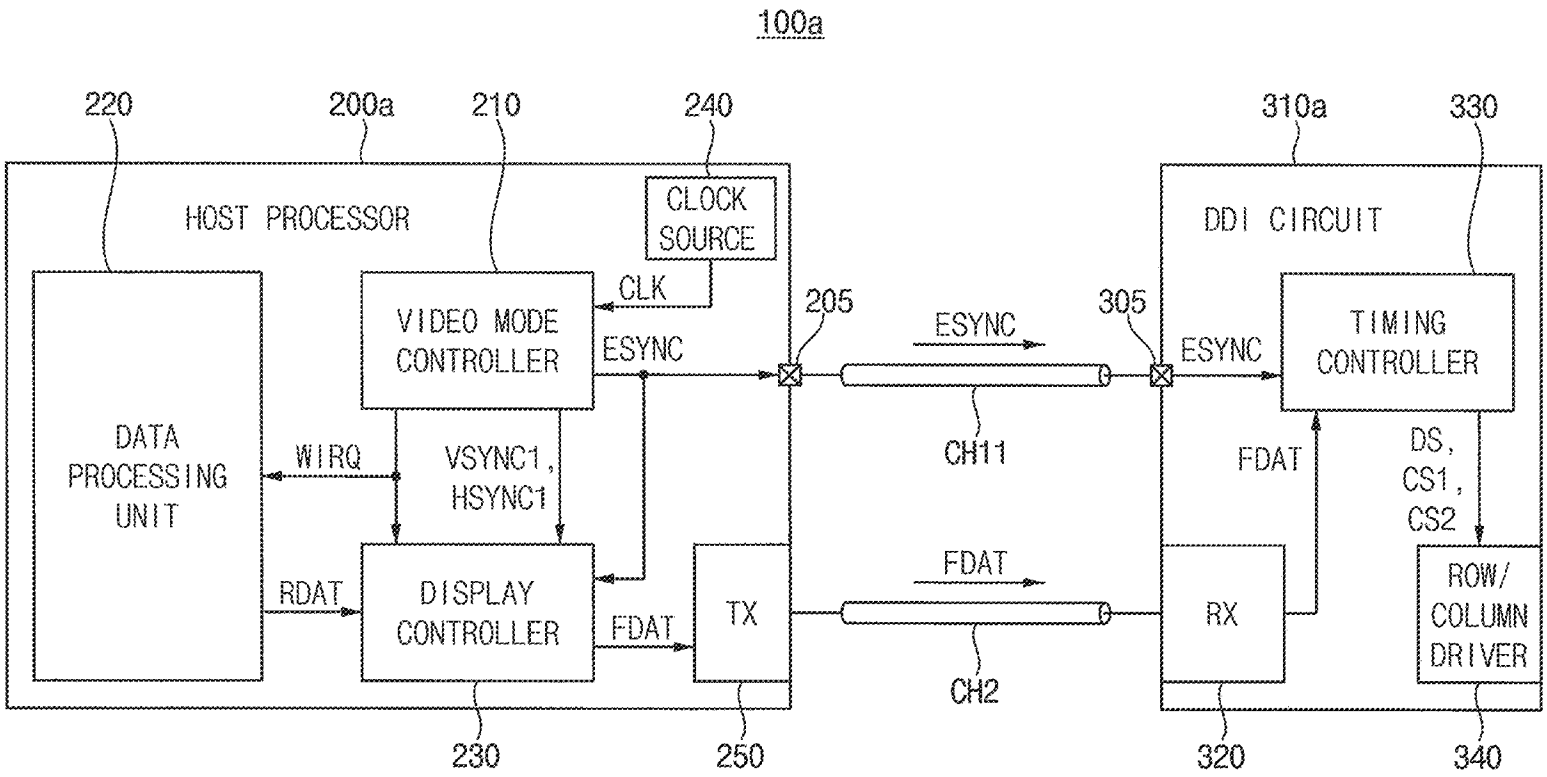
FIG. 2 is a block diagram illustrating an example of a display system of FIG. 1.

FIG. 2 is a block diagram illustrating an example of a display system of FIG. 1.

Referring to FIG. 2, a display system 100*a* includes a host processor 200*a* and a display driver integrated circuit 310*a*. The display system 100*a* may further include the first channel CH11 and the second channel CH2. For convenience of illustration, the display panel 350 in FIG. 1 is omitted.

The host processor 200*a* may include a video mode controller 210 and a display controller 230. The host processor 200*a* may further include a first pin 205, a data processing unit 220, a clock source (e.g., clock generator) 240 and a transmitter (TX) 250.

The clock source 240 may generate a clock signal CLK that is always toggled (e.g., regularly or periodically swings between a high level and a low level). For example, the clock signal CLK may be used to drive various components and generate various signals in the host processor 200*a*. For example, the clock source 240 may include a ring oscillator, an RC oscillator, a crystal oscillator, or a temperature compensated crystal oscillator (TCXO), but example embodiments are not limited thereto.

The video mode controller 210 may generate the first synchronization signal ESYNC based on the clock signal CLK, may generate a wakeup interrupt WIRQ by measuring the frame update period of the display panel 350, and may generate a first vertical synchronization signal VSYNC1 and a first horizontal synchronization signal HSYNC1 based on the clock signal CLK, the first synchronization signal ESYNC and the wakeup interrupt WIRQ. Detailed configurations of the video mode controller 210 will be described with reference to FIGS. 4, 5 and 6.

The video mode controller 210 may always be in an enabled state (e.g., may always be enabled). For example, even if the host processor 200*a* does not generate and output the frame data FDAT and enters an idle mode, the video mode controller 210 may always maintain an active mode without entering the idle mode. The idle mode may be referred to as a sleep mode, a standby mode, a power down mode, a power save mode, or the like.

The first synchronization signal ESYNC may be a signal used for the synchronization between the host processor 200*a* and the display driver integrated circuit 310*a*. For example, the first synchronization signal ESYNC may correspond to a horizontal synchronization signal used in the display device 300. For example, to minimize or prevent the flicker due to the slight skew (or difference) of the horizontal synchronization signal, and to minimize or prevent the horizontal synchronization signal from diverging due to the clock variation, the host processor 200*a* may generate the first synchronization signal ESYNC that is commonly used by the host processor 200*a* and the display driver integrated circuit 310*a* and may share the first synchronization signal ESYNC with the display driver integrated circuit 310*a*. For example, the first synchronization signal ESYNC may be always and/or continuously generated and provided to the display driver integrated circuit 310*a* regardless of the transmission of the frame data FDAT (e.g., even when the frame data FDAT is not transmitted).

The first vertical synchronization signal VSYNC1 and the first horizontal synchronization signal HSYNC1 may be signals used for controlling and/or adjusting a timing of the frame data FDAT inside the host processor 200*a*.

The data processing unit 220 may control an overall operation of the host processor 200*a*, and may provide raw data RDAT used to generate the frame data FDAT. For example, the data processing unit 220 may include a central processing unit (CPU), or the like.

The display controller 230 may control operations of the display device 300 and the display driver integrated circuit 310*a*, and may generate and output the frame data FDAT based on the first vertical synchronization signal VSYNC1, the first horizontal synchronization signal HSYNC1, the first synchronization signal ESYNC and the raw data RDAT. For example, the frame data FDAT may be generated and output in the form of a packet. The display controller 230 may be referred to as a display processing unit (DPU). Detailed configurations of the display controller 230 will be described with reference to FIGS. 7 and 8.

The data processing unit 220 and the display controller 230 may be selectively enabled (or activated) based on the wakeup interrupt WIRQ. For example, when the generation and output of the frame data FDAT are not desired, the data processing unit 220 and the display controller 230 may enter the idle mode. When the generation and output of the frame data FDAT are desired, the operation mode of the data processing unit 220 and the display controller 230 may be switched (or changed) from the idle mode to the active mode based on the wakeup interrupt WIRQ. A path through which the data processing unit 220 provides the raw data RDAT and a path through which the display controller 230 generates and outputs the frame data FDAT may correspond to the image providing path described with reference to FIG. 1, which is included in the host processor 200*a* and enabled based on the wakeup interrupt WIRQ.

The first pin 205 may be connected to the first channel CH11 that transmits the first synchronization signal ESYNC to the display driver integrated circuit 310*a*. For example, a pin may be a contact pin or a contact pad, but example embodiments are not limited thereto.

The transmitter 250 may be connected to the second channel CH2 that transmits the frame data FDAT to the display driver integrated circuit 310*a*. For example, the transmitter 250 may be implemented based on the MIPI standard.

Although not illustrated in FIG. 2, the host processor 200*a* may further include a system bus, a memory device, a storage device, a plurality of functional modules and a power management integrated circuit (PMIC). The system bus may correspond to a signal transmission path between the components in the host processor 200*a*. The memory device and the storage device may store instructions and data for the operation of the host processor 200*a*. The plurality of functional modules may perform various functions of the host processor 200*a*. The power management integrated circuit may provide an operating voltage to the components in the host processor 200*a*, and may control the above-described switching operation between the idle mode and the active mode.

In some example embodiments, the memory device may include a volatile memory device, such as a dynamic random access memory (DRAM), a static random access memory (SRAM), a mobile DRAM, or the like. In some example embodiments, the storage device may include a nonvolatile memory device, such as an erasable programmable read-only memory (EPROM), an electrically erasable programmable read-only memory (EEPROM), a flash memory, a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), or the like. In some example embodiments, the storage device may further include an embedded multimedia card (eMMC), a universal flash storage (UFS), a solid state drive (SSD), a hard disk drive (HDD), a CD-ROM, or the like.

In some example embodiments, the plurality of functional modules may include a communication module that performs a communication function (e.g., a code division multiple access (CDMA) module, a long term evolution (LTE) module, a radio frequency (RF) module, an ultra-wideband (UWB) module, a wireless local area network (WLAN) module, a worldwide interoperability for a microwave access (WIMAX) module, or the like), a camera module that performs a camera function, an input-output (I/O) module including a display module that performs a display function and a touch panel module that performs a touch sensing function, and an audio module including a microphone (MIC) module, a speaker module, or the like, that performs an I/O of audio signals. In some example embodiments, the plurality of functional modules may further include a global positioning system (GPS) module, a gyroscope module, or the like.

The display driver integrated circuit 310*a* may include a timing controller 330 and a row/column driver 340, and may not include a frame buffer (e.g., a GRAM). The display driver integrated circuit 310*a* may further include a second pin 305 and a receiver (RX) 320.

The second pin 305 may be connected to the first channel CH11 that receives the first synchronization signal ESYNC provided from the host processor 200*a*. For example, the second pin 305 may be implemented similarly to the first pin 205.

The receiver 320 may be connected to the second channel CH2 that receives the frame data FDAT provided from the host processor 200*a*. For example, the receiver 320 may be implemented based on the MIPI standard.

The timing controller 330 may generate a first control signal CS1, a second control signal CS2 and a data signal DS based on the first synchronization signal ESYNC and the frame data FDAT without storing the frame data FDAT.

The row/column driver 340 may generate a plurality of data voltages (e.g., a data voltage VDAT in FIG. 10) and a plurality of scan signals (e.g., a scan signal SSC in FIG. 10) that are provided to the display panel 350 based on the first control signal CS1, the second control signal CS2 and the data signal DS. The display panel 350 may display the frame image corresponding to the frame data FDAT based on the plurality of data voltages and the plurality of scan signals.

As described above, the display driver integrated circuit 310*a* may not include the frame buffer, and thus the above-described operation of the timing controller 330 and the row/column driver 340 (e.g., the operation of controlling the display panel 350 for displaying the frame image) may be performed without storing the frame data FDAT. A detailed configuration of the display device including the display driver integrated circuit 310*a* will be described with reference to FIGS. 9 and 10.

The first channel CH11 may include a single wire that electrically connects the first pin 205 with the second pin 305. For example, the first channel CH11 may represent a unidirectional or bidirectional signal line that can transmit the first synchronization signal ESYNC.

The second channel CH2 may include a plurality of wires that electrically connect the transmitter 250 with the receiver 320. For example, the second channel CH2 may represent a bidirectional digital interface that can transmit a digital stream (e.g., a sequence of bits).

In some example embodiments, the operation of transmitting the first synchronization signal ESYNC and the frame data FDAT may be performed during a video mode of the MIPI standard, but example embodiments are not limited thereto.

In the display system 100*a* according to some example embodiments, the display driver integrated circuit 310*a* may be implemented not to include the frame buffer. For example, the host processor 200*a* may measure the frame update period of the display panel 350, may enable the image providing path when the frame update or panel update is desired, and may transmit a new frame to the display driver integrated circuit 310*a* based on the emission time of the display panel 350. Further, only one frame may be transmitted to the display driver integrated circuit 310*a* because the display driver integrated circuit 310*a* does not include the frame buffer. Further, the host processor 200*a* may provide the first synchronization signal ESYNC through the first channel CH11, which is formed separately and/or independently from the second channel CH2 for transmitting the frame data FDAT, for the synchronization with the display driver integrated circuit 310*a*. Accordingly, the low frequency driving and the low power driving may be efficiently implemented.

Figure 3:
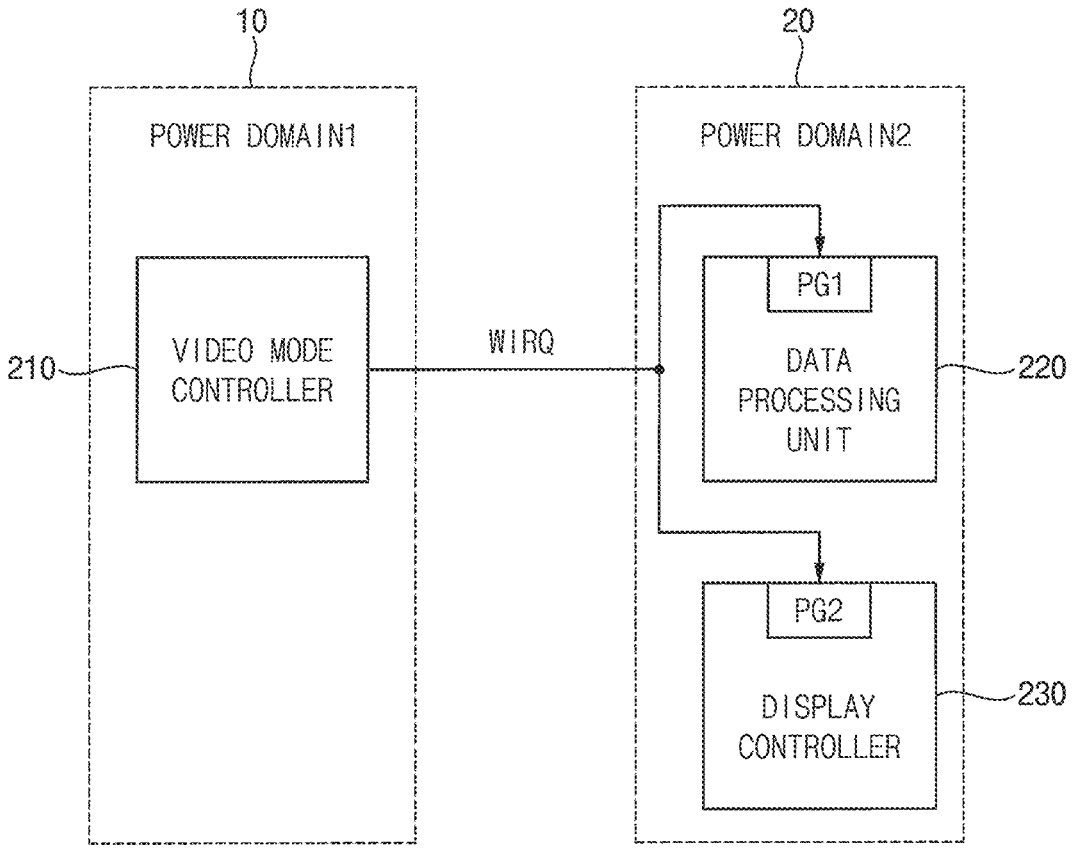
FIG. 3 is a diagram for describing power domains of a host processor included in a display system of FIG. 2.

FIG. 3 is a diagram for describing power domains of a host processor included in a display system of FIG. 2.

Referring to FIGS. 2 and 3, the host processor 200*a* (e.g., the application processor) may include a plurality of power domains 10 and 20 that are different from each other. For example, the plurality of power domains 10 and 20 may include a first power domain 10 and a second power domain 20. For example, the first power domain 10 may correspond to an always-powered domain where power is supplied in both of the active mode and the idle mode of the host processor 200*a*, and the second power domain 20 may correspond to a power-save domain where power is blocked in the idle mode of the host processor 200*a*.

According to some example embodiments, the active mode may represent that the host processor 200*a* is enabled and an operating system (OS) runs. The idle mode may represent a power down mode that at least a part of the host processor 200*a* is disabled.

In some example embodiments, as illustrated in FIG. 3, the video mode controller 210 may be disposed in the first power domain 10, and the data processing unit 220 and the display controller 230 may be included in the second power domain 20. As described above, the video mode controller 210 may generate the wakeup interrupt WIRQ, and the data processing unit 220 and the display controller 230 may be selectively enabled based on the wakeup interrupt WIRQ.

For example, the data processing unit 220 and the display controller 230 may include power gating circuits PG1 and PG2, respectively. The power gating circuits PG1 and PG2 may selectively supply power to the data processing unit 220 and the display controller 230, respectively, in response to the wakeup interrupt WIRQ. As such, the data processing unit 220 and the display controller 230 may be power-gated and enabled independently of each other.

Figure 4:
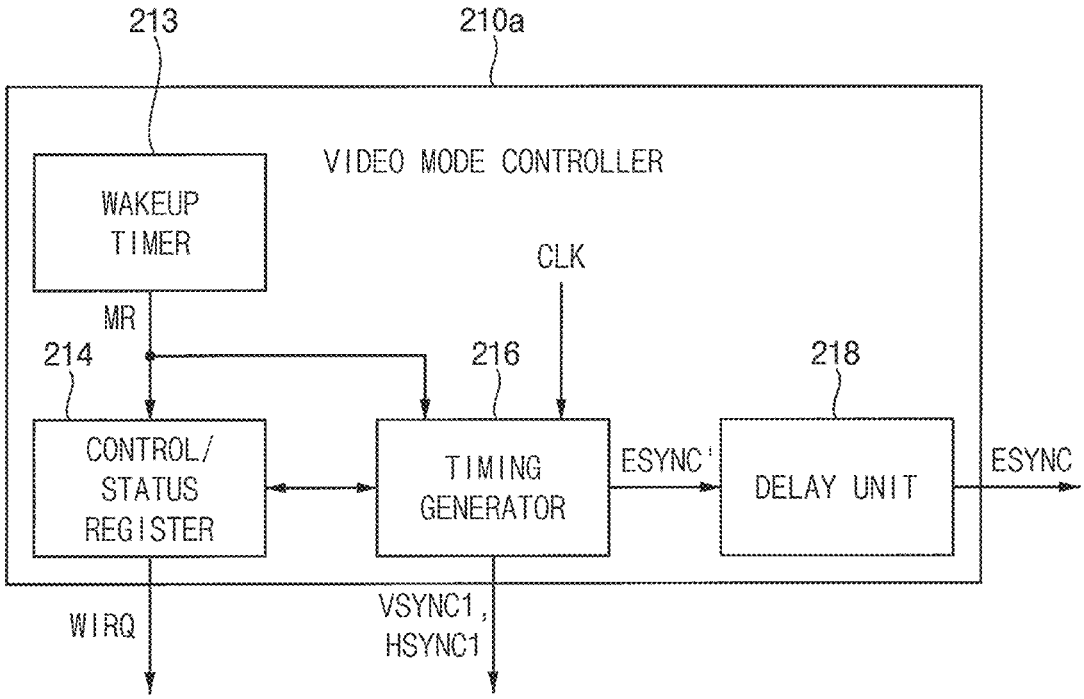
FIGS. 4, 5 and 6 are block diagrams illustrating examples of a video mode controller included in a host processor included in a display system of FIG. 2.
Figure 5:
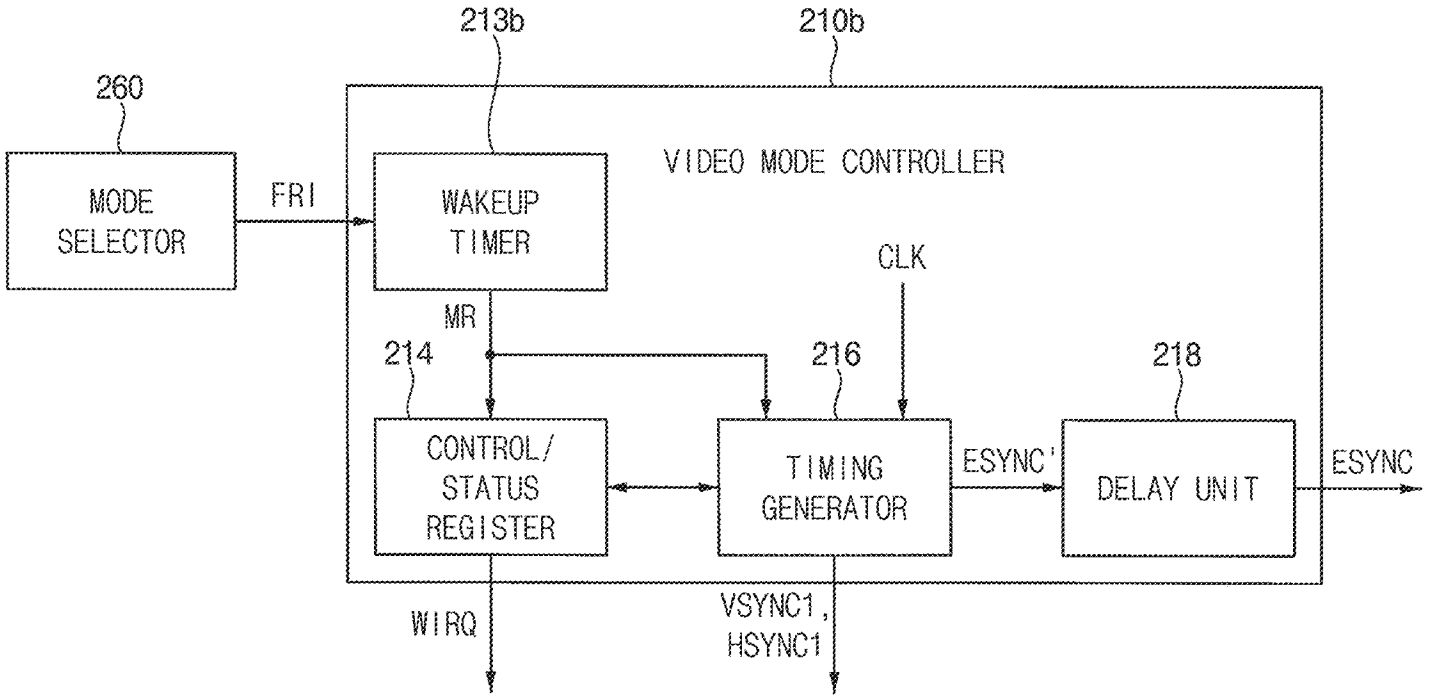
Figure 6:
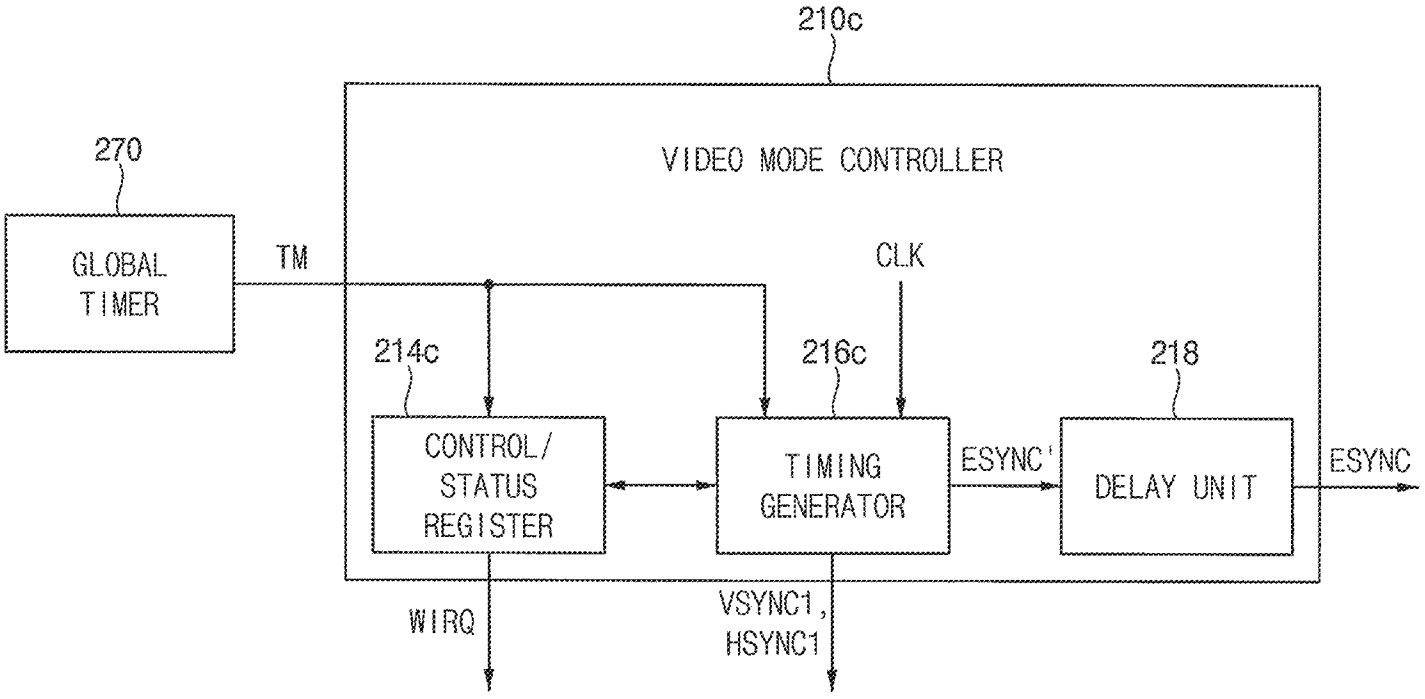

FIGS. 4, 5 and 6 are block diagrams illustrating examples of a video mode controller included in a host processor included in a display system of FIG. 2.

Referring to FIG. 4, a video mode controller 210*a* may include a wakeup timer 213, a control/status register 214 and a timing generator 216. The video mode controller 210*a* may further include a delay unit 218.

The wakeup timer 213 may measure the frame update period of the display panel 350, and may output a measuring result MR. In other words, the wakeup timer 213 may measure a time for the display panel 350 to be refreshed (e.g., a panel discharging time).

In some example embodiments, the frame update period measured by the wakeup timer 213 may be associated with or related to a retention characteristic of the display panel 350. For example, when the minimum driving frequency of the display panel 350 is about 1 Hz, e.g., when the display panel 350 can maintain an image for the maximum of about one second with the single update, the wakeup timer 213 may measure about one second that is a time corresponding to the minimum driving frequency.

The control/status register 214 may generate the wakeup interrupt WIRQ based on the measuring result MR provided from the wakeup timer 213. For example, the control/status register 214 may include a special function register (SFR). The control/status register 214 may be referred to as an interrupt controller.

The timing generator 216 may generate the first synchronization signal ESYNC based on the clock signal CLK, and the delay unit 218 may delay and output the first synchronization signal ESYNC. For example, the timing generator 216 may generate a signal ESYNC' corresponding to the first synchronization signal ESYNC, and the delay unit 218 may delay the signal ESYNC' and may output the delayed signal as the first synchronization signal ESYNC. As described above, the first synchronization signal ESYNC may be a signal used for the synchronization between the host processor 200*a* and the display driver integrated circuit 310*a*, and thus the first synchronization signal ESYNC may be always toggled and may always maintain an active state. For example, the delay unit 218 may include a delay element for matching the skew between the first synchronization signal ESYNC and a synchronization signal output through the serial interface from the display controller 230.

The timing generator 216 may generate the first vertical synchronization signal VSYNC1 and the first horizontal synchronization signal HSYNC1 based on the measuring result MR, the clock signal CLK and the first synchronization signal ESYNC. For example, when the wakeup interrupt WIRQ is generated or issued, the timing generator 216 may generate and provide the first vertical synchronization signal VSYNC1 and the first horizontal synchronization signal HSYNC1 to the display controller 230. As described above, the first vertical synchronization signal VSYNC1 and the first horizontal synchronization signal HSYNC1 may be signals used for controlling and/or adjusting the timing of the frame data FDAT inside the host processor 200*a*, and thus the first vertical synchronization signal VSYNC1 and the first horizontal synchronization signal HSYNC1 may be generated only when the display controller 230 is enabled. The first vertical synchronization signal VSYNC1 and the first horizontal synchronization signal HSYNC1 may be referred to as video synchronization signals.

In other words, the wakeup timer 213 may be a component that measures the time for the display panel 350 to be refreshed in order to recognize in advance when the panel update is desired. The control/status register 214 may be a component that wakes up the display system 10*a* when desired and controls the operation of transmitting the frame to be displayed to the display panel 350. The timing generator 216 may be a component that generates the signal for the synchronization between the host processor 200*a* and the display driver integrated circuit 310*a*.

Referring to FIG. 5, a video mode controller 210*b* may include a wakeup timer 213*b*, a control/status register 214 and a timing generator 216. The video mode controller 210*b* may further include a delay unit 218. The descriptions mentioned in connection with FIG. 4 will be omitted.

The video mode controller 210*b* may be substantially the same as the video mode controller 210*a* of FIG. 4, except that the host processor 200*a* further includes a mode selector 260 and an operation of the wakeup timer 213*b* is partially changed.

The mode selector 260 may set the frame update period of the display panel 350, and may output frame setting information FRI. For example, the mode selector 260 may set the frame update period in a range from the minimum driving frequency to a settable maximum driving frequency of the display panel 350, based on the type of frame images, the type of applications, the user's setting, etc. For example, the frame update period may be set to about 60 Hz that is a normal driving frequency, may be set to about 10 Hz that is lower than the normal driving frequency, or may be set to about 1 Hz that is the minimum driving frequency.

The wakeup timer 213*b* may measure the frame update period of the display panel 350 that is set by the mode selector 260, based on the frame setting information FRI that is provided from the mode selector 260, and may output the measuring result MR.

Referring to FIG. 6, a video mode controller 210*c* may include a control/status register 214*c* and a timing generator 216*c*. The video mode controller 210*c* may further include a delay unit 218. The descriptions mentioned in connection with FIG. 4 will be omitted.

The video mode controller 210*c* may be substantially the same as the video mode controller 210*a* of FIG. 4, except that the host processor 200*a* further includes a global timer 270 and the wakeup timer 213 is omitted and the operations of the control/status register 214*c* and the timing generator 216*c* are partially changed.

The global timer 270 may generate time information TM and may provide the time information TM to the entire host processor 200*a*. For example, the time information TM may be provided to the control/status register 214*c* and the timing generator 216*c*. The global timer 270 may be referred to as a system timer.

The control/status register 214*c* may generate the wakeup interrupt WIRQ based on the time information TM provided from the global timer 270.

The timing generator 216*c* may generate the first vertical synchronization signal VSYNC1 and the first horizontal synchronization signal HSYNC1 based on the time information TM, the clock signal CLK and the first synchronization signal ESYNC.

Figure 7:
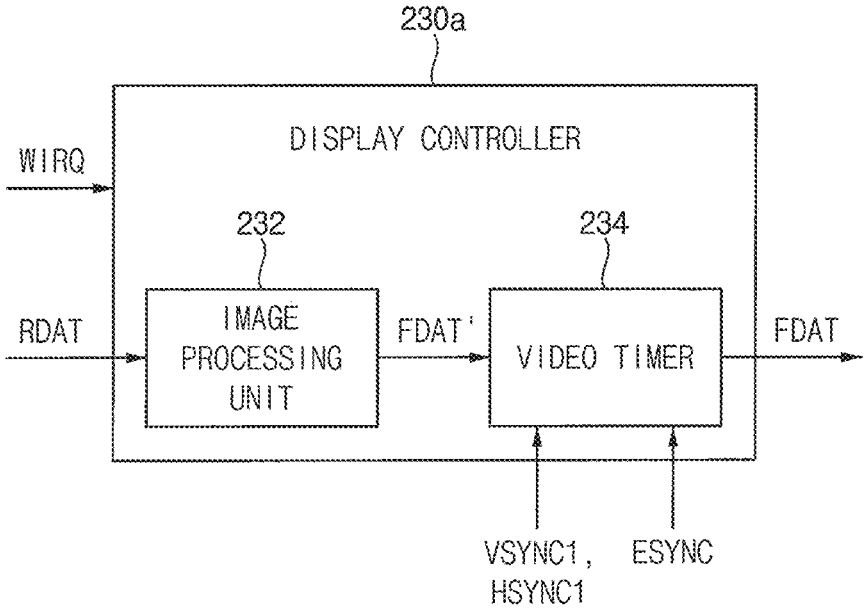
FIGS. 7 and 8 are block diagrams illustrating examples of a display controller included in a host processor included in a display system of FIG. 2.
Figure 8:
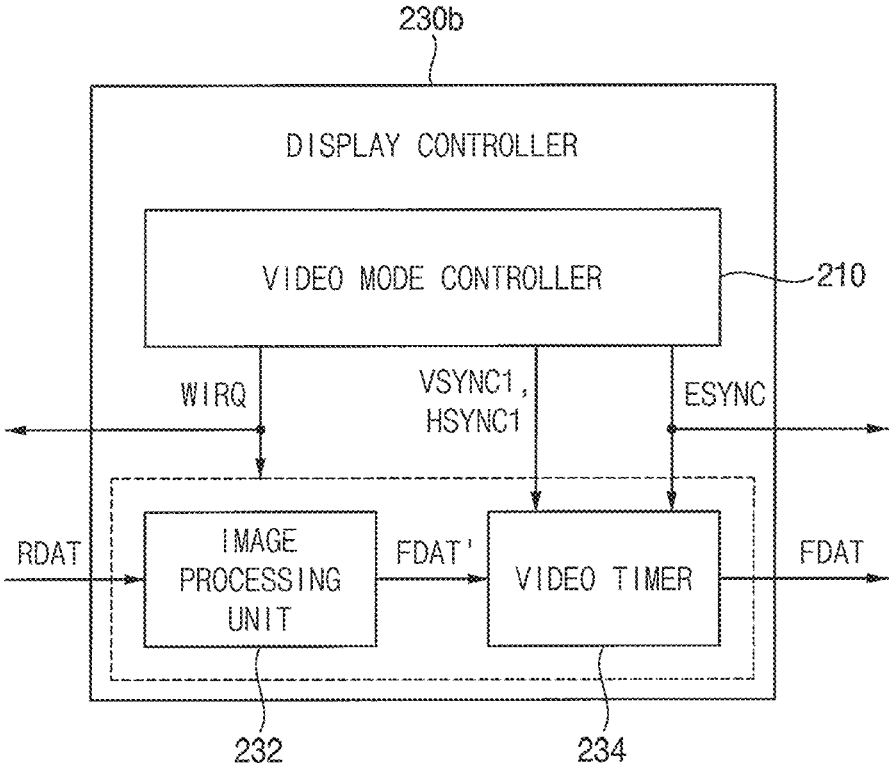

FIGS. 7 and 8 are block diagrams illustrating examples of a display controller included in a host processor included in a display system of FIG. 2.

Referring to FIG. 7, a display controller 230*a* may include an image processing unit 232 and a video timer 234.

The image processing unit 232 may be selectively enabled based on the wakeup interrupt WIRQ, and may generate the frame data FDAT based on the raw data RDAT provided from the data processing unit 220 when enabled. For example, the image processing unit 232 may generate data FDAT' corresponding to the frame data FDAT.

In some example embodiments, although not illustrated in detail, the image processing unit 232 may include a blender that blends a plurality of layers, and a display quality enhancer that performs at least one display quality enhancement algorithm (or image quality improvement algorithm).

Blending represents an operation of calculating a pixel value that is actually displayed among several layers (e.g., images) constituting one screen. When the blending is performed, a pixel value that is actually displayed on each pixel may be obtained. For example, when only one layer is disposed, arranged or placed on a pixel, a pixel value included in the one layer may be obtained as it is. When two or more layers are disposed on a pixel, a pixel value included in one layer among the two or more layers may be obtained, or a new pixel value may be obtained based on pixel values included in the two or more layers. The blending may be referred to as mixing and/or composition.

In some example embodiments, the at least one display quality enhancement algorithm may include a detail enhancement (DE), a scaling (or scaler), an adaptive tone map control (ATC), a hue saturation control (HSC), a gamma and a de-gamma, an Android open source project (AOSP), a color gamut control (CGC), a dithering (or dither), a round corner display (RCD), a sub-pixel rendering (SPR), or the like. The DE may represent an algorithm for sharpening an outline of an image. The scaling may represent an algorithm that changes a size of an image. The ATC may represent an algorithm for improving the outdoor visibility. The HSC may represent an algorithm for improving the hue and saturation for color. The gamma may represent an algorithm for gamma correction or compensation. The AOSP may represent an algorithm for processing an image conversion matrix (e.g., a mode for a color-impaired person or a night mode) defined by the Android OS. The CGC may represent an algorithm for matching color coordinates of a display panel. The dithering may represent an algorithm for expressing the effect of color of high bits using limited colors. The RCD may represent an algorithm for processing rounded corners of a display panel. The SPR may represent an algorithm for increasing the resolution. However, example embodiments are not limited thereto, and the at least one display quality enhancement algorithm may further include various other algorithms.

The video timer 234 may control the timing of the frame data FDAT based on the first vertical synchronization signal VSYNC1, the first horizontal synchronization signal HSYNC1 and the first synchronization signal ESYNC. For example, the video timer 234 may output the frame data FDAT by adjusting a timing of the data FDAT'.

In other words, the video timer 234 may be a component that starts a new frame based on the light emission time of the display panel 350, transmits only one frame, and generates timing information based on the synchronization signal. For example, the video timer 234 may transmit only one frame in the video mode and may generate the timing information through a display serial interface (DSI).

Referring to FIG. 8, a display controller 230*b* may include an image processing unit 232 and a video timer 234. The display controller 230*b* may further include the video mode controller 210. The descriptions mentioned in connection with FIG. 7 will be omitted.

The display controller 230*b* may be substantially the same as the display controller 230*a* of FIG. 7, except that the video mode controller 210 is included and/or disposed in the display controller 230*b*. The video mode controller 210 may be implemented as described with reference to FIGS. 4, 5 and 6.

Figure 9:
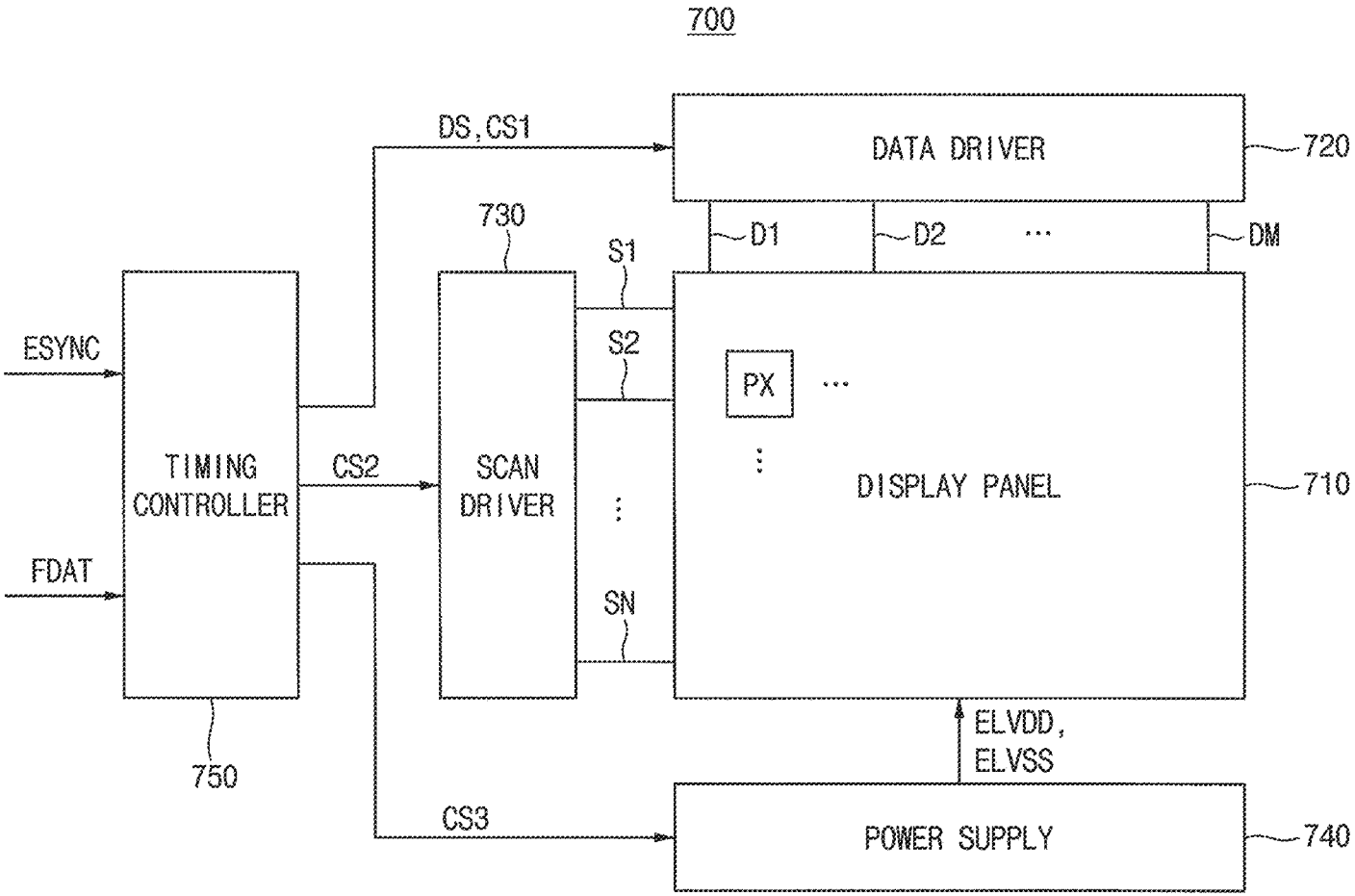
FIG. 9 is a block diagram illustrating a display device included in a display system according to an example embodiment.

FIG. 9 is a block diagram illustrating a display device included in a display system according to an example embodiment.

Referring to FIG. 9, a display device 700 includes a display panel 710 and a display driver integrated circuit. The display driver integrated circuit may include a data driver 720, a scan driver 730, a power supply 740, and a timing controller 750.

The display panel 710 operates (e.g., displays an image) based on image data (e.g., based on frame data). The display panel 710 may be connected to the data driver 720 through a plurality of data lines D1, D2, . . . , DM, and may be connected to the scan driver 730 through a plurality of scan lines S1, S2, . . . , SN. The plurality of data lines D1, D2, . . . , DM may extend in a first direction, and the plurality of scan lines S1, S2, . . . , SN may extend in a second direction crossing (e.g., substantially perpendicular to) the first direction.

The display panel 710 may include a plurality of pixels PX that are arranged in a matrix form having a plurality of rows and a plurality of columns. As will be described with reference to FIG. 10, each of the plurality of pixels PX may include a light emitting element and at least one transistor for driving the light emitting element. Each of the plurality of pixels PX may be electrically connected to a respective one of the plurality of data lines D1, D2, . . . , DM and a respective one of the plurality of scan lines S1, S2, . . . , SN.

In some example embodiments, the display panel 710 may be a self-emitting display panel that emits light without the use of a backlight unit. For example, the display panel 710 may be an organic light emitting display panel that includes an organic light emitting diode (OLED) as the light emitting element.

In some example embodiments, the display panel 710 may have relatively good (e.g., excellent) retention characteristics capable of performing the low frequency driving.

For example, the display panel 710 may be an oxide-based organic light emitting display panel that includes an organic light emitting diode as the light emitting element and includes the at least one transistor including low-temperature polycrystalline oxide (LTPO).

However, example embodiments are not limited thereto, and the display panel 710 may be a liquid crystal display (LCD) panel that includes a backlight unit and is capable of performing the low frequency driving.

In some example embodiments, each of the plurality of pixels PX included in the display panel 710 may have various configurations depending on a driving scheme of the display device 700. For example, the display device 700 may be driven with an analog or a digital driving scheme. While the analog driving scheme produces grayscale using variable voltage levels corresponding to input data, the digital driving scheme produces grayscale using variable time duration in which the light emitting diode emits light. The analog driving scheme is difficult to implement because it needs a driving integrated circuit (IC) that is complicated to manufacture when the display is large and desires a high resolution. The digital driving scheme, on the other hand, can easily accomplish the desired high resolution through a simpler IC structure. An example of each of the plurality of pixels PX will be described with reference to FIG. 10.

The timing controller 750 may control overall operations of the display device 700. For example, the timing controller 750 may receive the first synchronization signal ESYNC from the host processor 200, and may provide predetermined control signals CS1, CS2 and CS3 to the data driver 720, the scan driver 730 and the power supply 740 based on the first synchronization signal ESYNC to control the operations of the display device 700. For example, the control signals CS1, CS2 and CS3 may include a vertical synchronization signal and a horizontal synchronization signal that are used inside the display device 700.

The timing controller 750 may receive the frame data FDAT from the host processor 200, and generates a data signal DS for displaying an image based on the frame data FDAT. For example, the frame data FDAT may include red image data, green image data and blue image data. Further, the frame data FDAT may include white image data. In some example embodiments, the frame data FDAT may include magenta image data, yellow image data, cyan image data, or the like.

The data driver 720 may generate a plurality of data voltages based on the control signal CS1 and the data signal DS, and may apply the plurality of data voltages to the display panel 710 through the plurality of data lines D1, D2, . . . , DM. For example, the data driver 720 may include a digital-to-analog converter (DAC) that converts the data signal DS in a digital form into the plurality of data voltages in an analog form.

The scan driver 730 may generate a plurality of scan signals based on the control signal CS2, and may apply the plurality of scan signals to the display panel 710 through the plurality of scan lines S1, S2, . . . , SN. The plurality of scan lines S1, S2, . . . , SN may be sequentially activated based on the plurality of scan signals.

The timing controller 750 may correspond to the timing controller 330 in FIG. 2, and the data driver 720 and the scan driver 730 may correspond to the row/column driver 340 in FIG. 2.

In some example embodiments, the data driver 720, the scan driver 730 and the timing controller 750 may be implemented as one integrated circuit. In some other example embodiments, the data driver 720, the scan driver 730 and the timing controller 750 may be implemented as two or more integrated circuits. A driving module including at least the timing controller 750 and the data driver 720 may be referred to as a timing controller embedded data driver (TED).

The power supply 740 may supply a first power supply voltage ELVDD and a second power supply voltage ELVSS to the display panel 710 based on the control signal CS3. For example, the first power supply voltage ELVDD may be a high power supply voltage, and the second power supply voltage ELVSS may be a low power supply voltage.

In some example embodiments, at least some of the elements included in the display driver integrated circuit may be disposed, e.g., directly mounted, on the display panel 710, or may be connected to the display panel 710 in a tape carrier package (TCP) type. In some example embodiments, at least some of the elements included in the display driver integrated circuit may be integrated on the display panel 710. In some example embodiments, the elements included in the display driver integrated circuit may be respectively implemented with separate circuits/modules/chips. In some other example embodiments, on the basis of a function, some of the elements included in the display driver integrated circuit may be combined into one circuit/module/chip, or may be further separated into a plurality of circuits/modules/chips.

Figure 10:
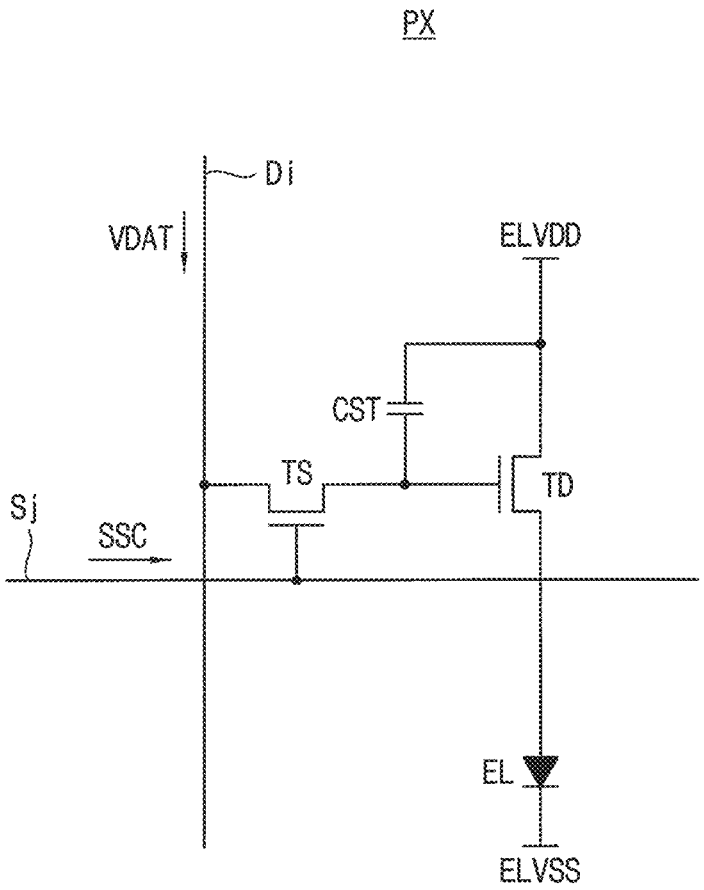
FIG. 10 is a circuit diagram illustrating an example of a pixel included in a display panel included in a display device of FIG. 9.

FIG. 10 is a circuit diagram illustrating an example of a pixel included in a display panel included in a display device of FIG. 9.

Referring to FIG. 10, each pixel PX may include a switching transistor TS, a storage capacitor CST, a driving transistor TD and an organic light emitting diode EL.

The switching transistor TS may have a first electrode connected to a data line Di, a second electrode connected to the storage capacitor CST, and a gate electrode connected to a scan line Sj. The switching transistor TS may transfer a data voltage VDAT received from the data driver 720 to the storage capacitor CST in response to a scan signal SSC received from the scan driver 730.

The storage capacitor CST may have a first electrode connected to the first power supply voltage ELVDD and a second electrode connected to a gate electrode of the driving transistor TD and the second electrode of the storage capacitor CST. The storage capacitor CST may store the data voltage VDAT transferred through the switching transistor TS.

The driving transistor TD may have a first electrode connected to the first power supply voltage ELVDD, a second electrode connected to the organic light emitting diode EL, and the gate electrode connected to the storage capacitor CST. The driving transistor TD may be turned on or off depending on the data voltage VDAT stored in the storage capacitor CST.

The organic light emitting diode EL may have an anode electrode connected to the driving transistor TD and a cathode electrode connected to the second power supply voltage ELVSS. The organic light emitting diode EL may emit light based on a current flowing from the first power supply voltage ELVDD to the second power supply voltage ELVSS while the driving transistor TD is turned on. The brightness of the pixel PX may increase as the current flowing through the organic light emitting diode EL increases.

In some example embodiments, the switching transistor TS and the driving transistor TD may include LTPO. For example, the driving transistor TD may be a low-temperature poly-silicon (LTPS) thin film transistor (TFT) including LTPS, and the switching transistor TS may be an oxide TFT including oxide semiconductor. The LTPS TFT may be suitable or appropriate for a current driving because of relatively high electron mobility. The oxide TFT may be suitable or appropriate for a switching because of relatively low leakage current. Thus, when the LTPS TFT and the oxide TFT are used together, improved characteristics (e.g., the excellent retention characteristics) may be obtained. A pixel that includes both the LTPS TFT and the oxide TFT may be referred to as a LTPO pixel, and a display panel that includes the LTPO pixel may be referred to as a hybrid oxide panel (HOP).

Although FIG. 10 illustrates an organic light emitting diode pixel as an example of each pixel PX that may be included in the display panel 710, it would be understood that example embodiments are not limited to the organic light emitting diode pixel and may be applied to any pixels of various types and configurations.

FIGS. 11A, 11B, 11C, 11D, 12A, 12B, 12C and 12D are diagrams for describing an operation of a display device included in a display system of FIG. 1.

Referring to FIGS. 11A, 11B, 11C and 11D, the display driver integrated circuit 310 included in the display device 300 may drive the display panel 350 by dividing one frame interval TF into a plurality of sub-intervals (e.g., N sub-intervals where N is a natural number greater than or equal to one). The one frame interval TF may represent a time interval in which one frame image is displayed on the display panel 350. For example, $N=2^M$ where M is zero or a natural number greater than or equal to one.

Figure 11A:
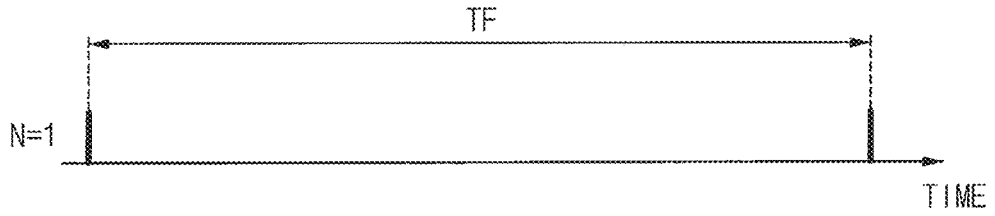
FIGS. 11A, 11B, 11C, 11D, 12A, 12B, 12C and 12D are diagrams for describing an operation of a display device included in a display system of FIG. 1.

For example, FIG. 11A illustrates an example where N=1. In other words, the frame interval TF may not be divided into sub-sections. In FIG. 11A and following figures, bold vertical lines may indicate a start point and an end point of the frame interval TF, and may indicate, for example, pulses included in a vertical synchronization signal.

Figure 11B:
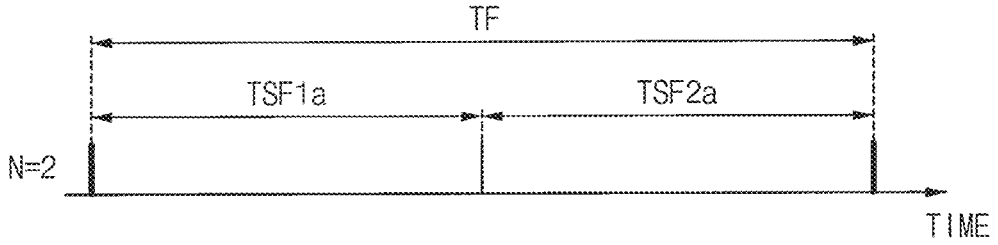
Figure 11C:
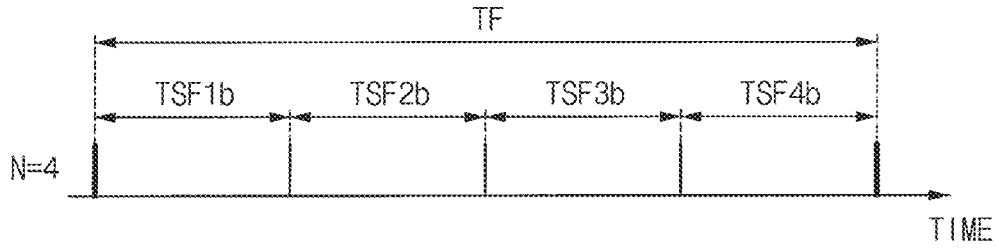
Figure 11D:
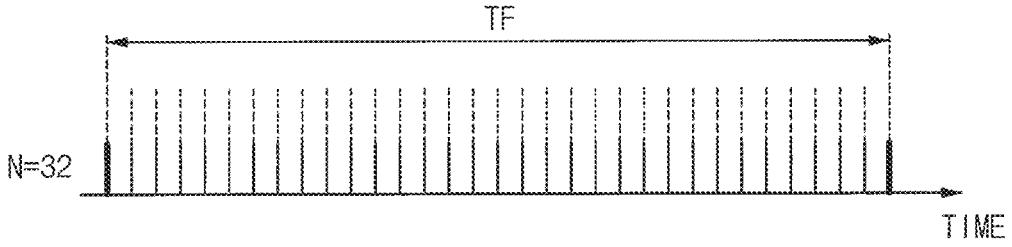

FIG. 11B illustrates an example where N=2 and the frame interval TF is divided into two sub-sections TSF1*a* and TSF2*a*. Similarly, FIG. 11C illustrates an example where N=4 and the frame interval TF is divided into four sub-sections TSF1*b*, TSF2*b*, TSF3*b* and TSF4*b*. FIG. 11D illustrates an example where N=32 and the frame interval TF is divided into thirty two sub-sections. However, example embodiments are not limited thereto. In some example embodiments, N may be changed to an optimized value that is suitable for a configuration of the display system 100.

In some example embodiments, the row/column driver 340 may start an operation of displaying the frame image in the first sub-interval that appears or arrives first after the frame data FDAT is received among the plurality of sub-intervals. The operation of displaying the frame image based on the sub-interval will be described in detail with reference to FIG. 12D.

Figure 12A:
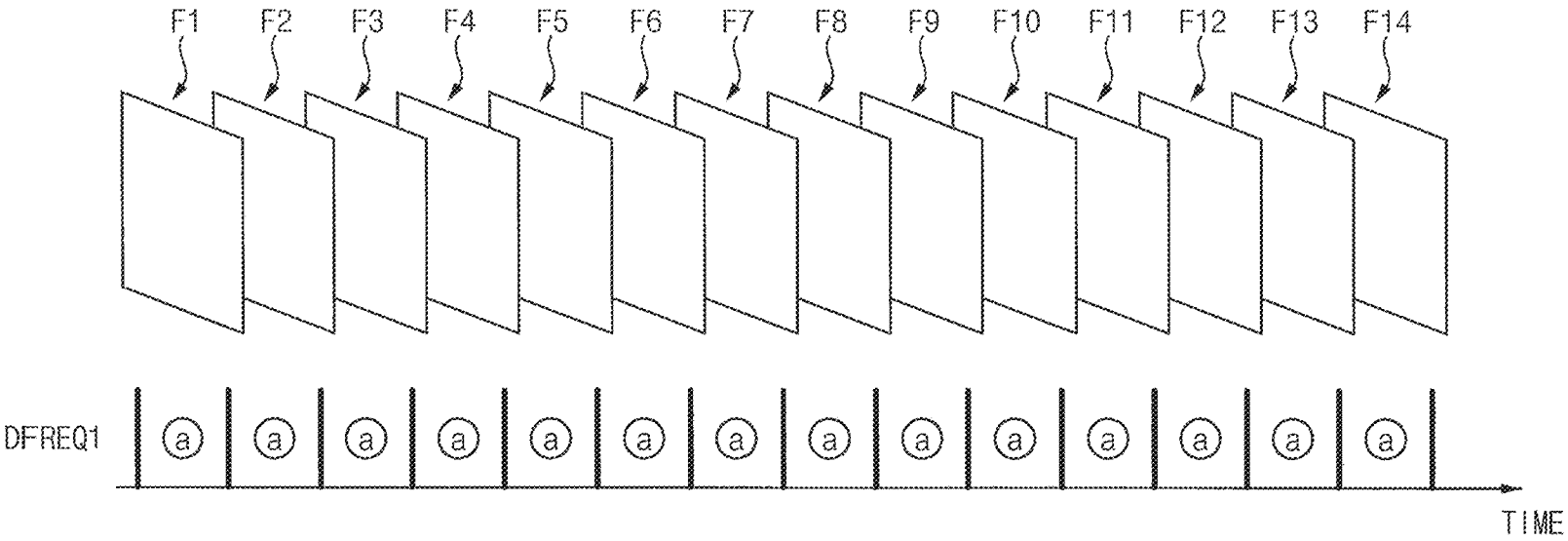
Figure 12B:
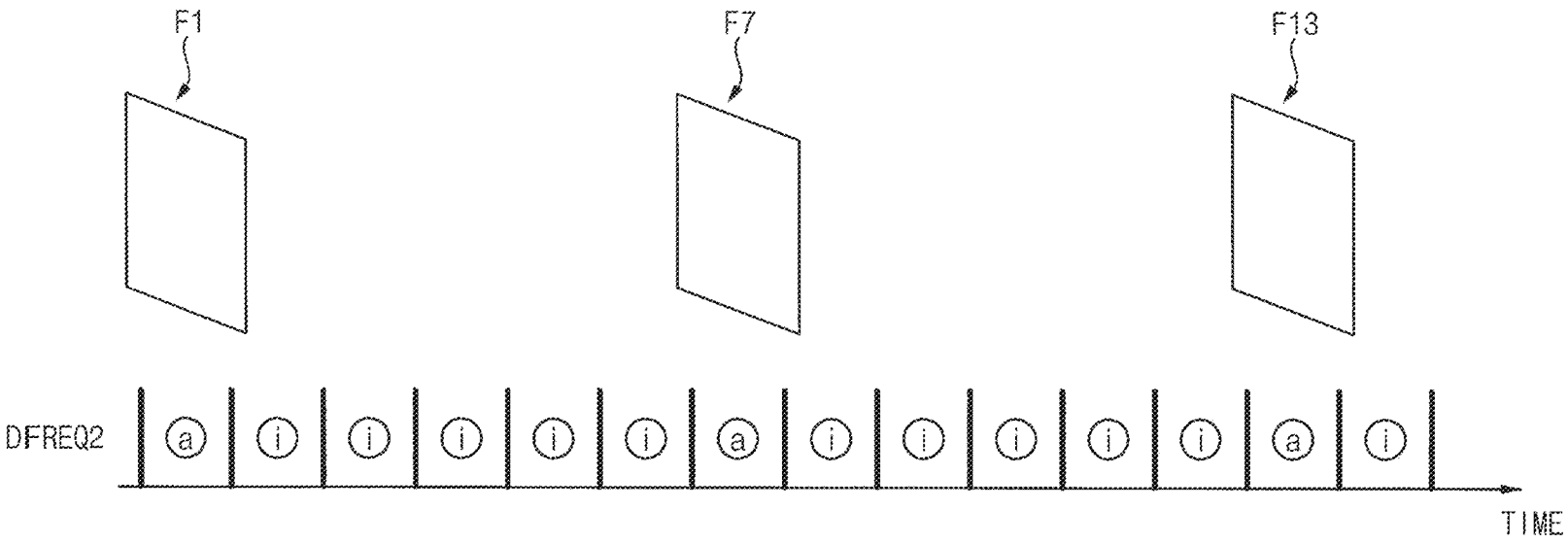
Figure 12C:
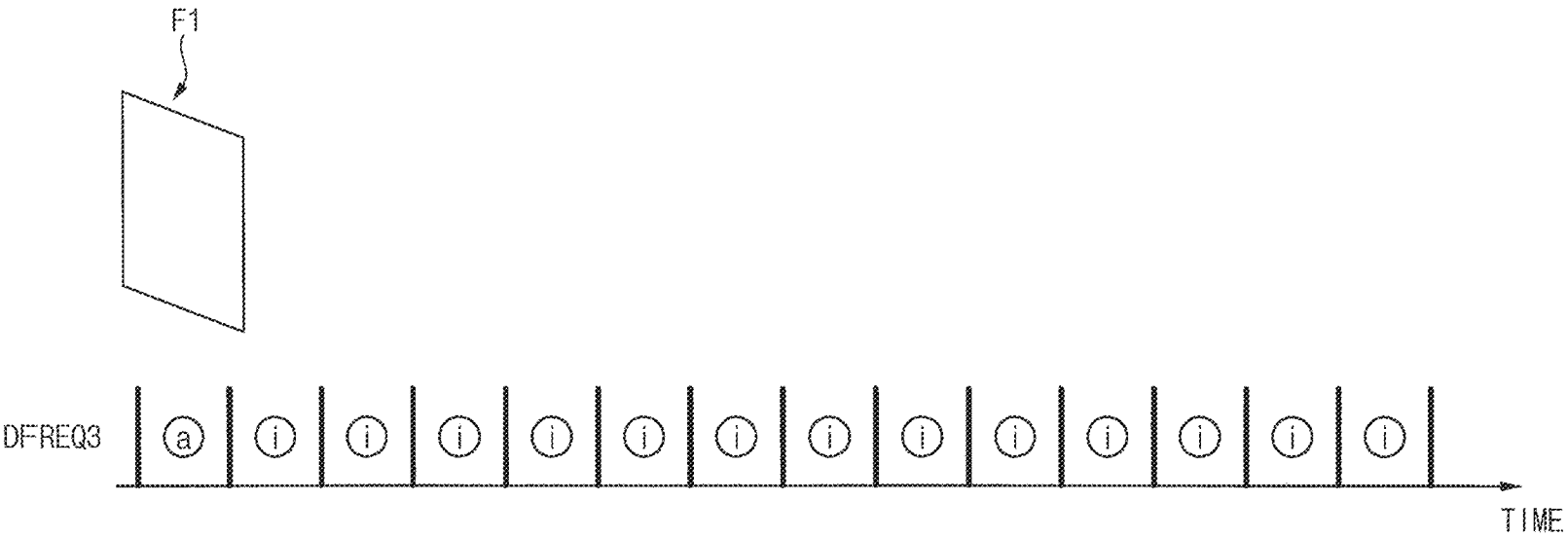

Referring to FIGS. 12A, 12B and 12C, the display device 300 may operate based on various driving frequencies.

FIG. 12A illustrates an example where the display device 300 operates based on a first driving frequency DFREQ1. For example, the first driving frequency DFREQ1 may be about 60 Hz that is the normal driving frequency. In an example of FIG. 12A, the frame data FDAT corresponding to frame images F1, F2, F3, F4, F5, F6, F7, F8, F9, F10, F11, F12, F13 and F14 may be generated and provided for every frame, and the display panel 350 may display a respective one of the frame images F1 to F14 during every frame. In other words, in an example of FIG. 12A, all frames may be active frames ⓐ that display actual frame images.

FIG. 12B illustrates an example where the display device 300 operates based on a second driving frequency DFREQ2. For example, the second driving frequency DFREQ2 may be about 10 Hz. In an example of FIG. 12B, the frame data FDAT corresponding to the frame images F1, F7 and F13 may be generated and provided for each of (6K+1)-th frames where K is zero or a natural number greater than or equal to one, and the display panel 350 may display a respective one of the frame images F1, F7 and F13 during each of the (6K+1)-th frames. During the remaining (or rest, remainder) frames other than the (6K+1)-th frames, the frame image displayed in the previous frame may be maintained without the generating and providing of the frame data FDAT, and the components for generating and providing the frame data FDAT inside the display system 100 may enter the idle mode. In other words, in an example of FIG. 12B, only the (6K+1)-th frames may be active frames ⓐ, and the remaining frames may be idle frames ⓘ.

FIG. 12C illustrates an example where the display device 300 operates based on a third driving frequency DFREQ3. For example, the third driving frequency DFREQ3 may be about 1 Hz that is the minimum driving frequency. In an example of FIG. 12C, the frame data FDAT corresponding to the frame image F1 may be generated and provided for each of (60K+1)-th frames, and the display panel 350 may display the frame image F1 during each of the (60K+1)-th frames. During the remaining frames other than the (60K+1)-th frames, the frame image displayed in the previous frame may be maintained. In other words, in an example of FIG. 12C, only the (60K+1)-th frames may be active frames ⓐ, and the remaining frames may be idle frames ⓘ.

In some example embodiments, each of FIGS. 12B and 12C may represent an operation mode for displaying a still image (or static image, stopped image).

Figure 12D:
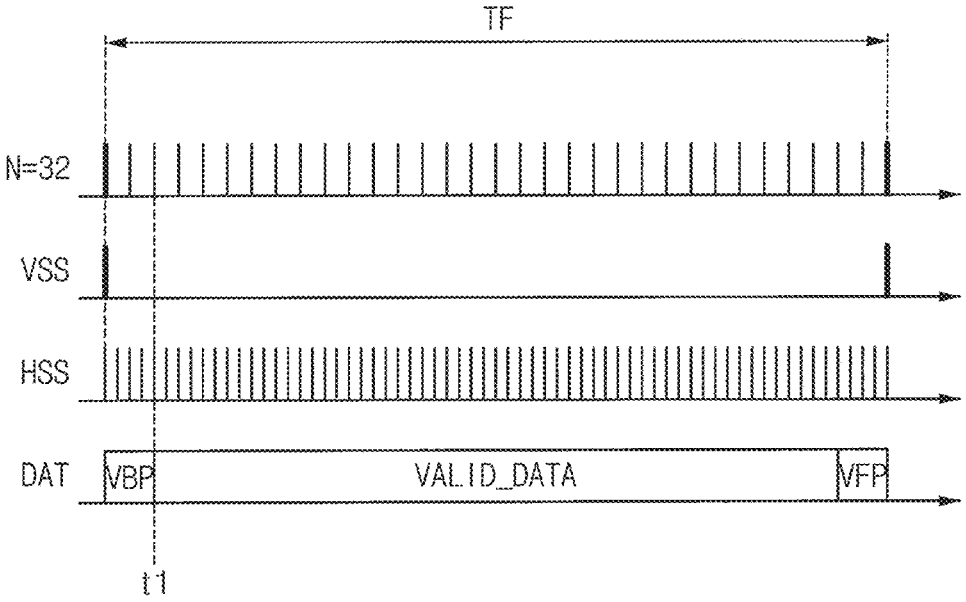

Referring to FIG. 12D, when the low frequency driving is performed as illustrated in FIGS. 12B and 12C, a start point of a new frame may be controlled and/or adjusted using the plurality of sub-intervals illustrated in FIGS. 11B, 11C and 11D.

As with the example of FIG. 11D, FIG. 12D illustrates an example where N=32 and the frame interval TF is divided into thirty two sub-sections. In FIG. 12D, VSS, HSS and DAT may represent a vertical synchronization signal, a horizontal synchronization signal and a data signal, respectively, that are used in the display device 300.

When the start point of the new frame is controlled and/or adjusted, a function of starting the new frame without the difference in display quality may be provided by dividing the light emission time of the display panel 350 into N sub-intervals. When the operation mode is switched from the idle mode to the active mode (e.g., when the displayed frame is changed from the idle frame ⓘ to the active frame ⓐ), it may not wait until a start of a next frame interval even if valid data VALID_DATA is received after a start of a current frame, and the new frame may be started at a time that appears at the earliest sub-interval among the divided N sub-intervals in a current frame interval. In an example of FIG. 12D, the new frame may be started at time t1 (e.g., at a start point of a third sub-interval among thirty two sub-intervals) when the valid data VALID_DATA is received in the current frame interval. In FIG. 12D, VBP before the valid data VALID_DATA may represent a back porch interval, and VFP after the valid data VALID_DATA may represent a front porch interval.

When the low frequency driving is performed by the display system 100 according to some example embodiments, the data may be transmitted only in the active frame ⓐ, and most components of the display system 100 may be switched to the idle mode in the idle frame ⓘ, even if the display driver integrated circuit 310 does not include the frame buffer. Accordingly, power consumption may be reduced.

Figure 13:
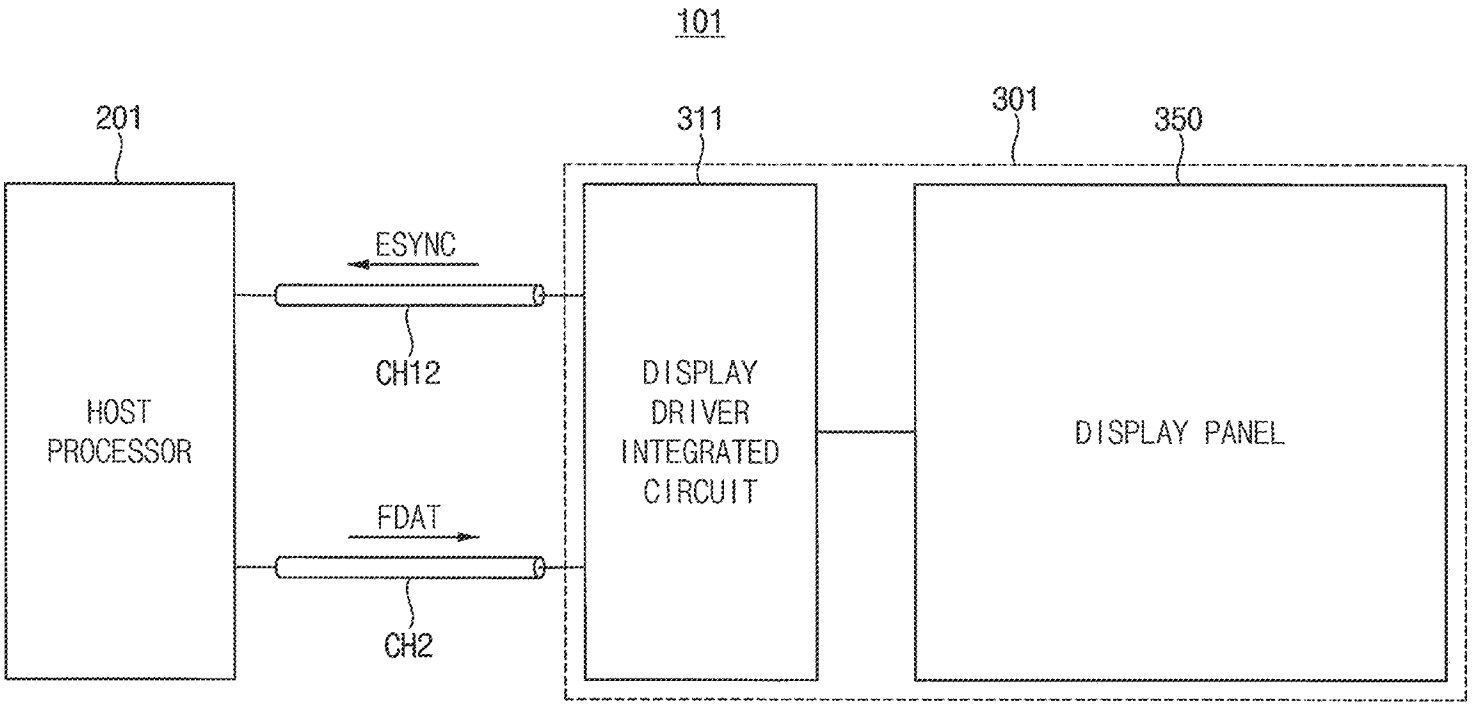
FIG. 13 is a block diagram illustrating a display system according to an example embodiment.

FIG. 13 is a block diagram illustrating a display system according to an example embodiment. The descriptions mentioned in connection with FIG. 1 will be omitted.

Referring to FIG. 13, a display system 101 includes a host processor 201 and a display device 301. The display device 301 includes a display driver integrated circuit 311 and a display panel 350. The display system 101 may further include a first channel CH12 and a second channel CH2.

The display system 101 may be substantially the same as the display system 100 of FIG. 1, except that a first synchronization signal ESYNC that is used for the synchronization between the host processor 201 and the display driver integrated circuit 311 is generated from the display driver integrated circuit 311 and is provided to the host processor 201.

The display driver integrated circuit 311 controls the display panel 350, and generates and outputs the first synchronization signal ESYNC. The first synchronization signal ESYNC may be substantially the same as the first synchronization signal ESYNC in FIG. 1. An example of FIG. 13 may be referred to as a DDI centric interface in which the display driver integrated circuit 311 generates the first synchronization signal ESYNC.

The host processor 201 receives the first synchronization signal ESYNC from the display driver integrated circuit 311. The host processor 201 generates a wakeup interrupt by measuring a frame update period of the display panel 350, generates frame data FDAT based on the first synchronization signal ESYNC by enabling an image providing path based on the wakeup interrupt, and outputs the frame data FDAT for every frame update period.

The display driver integrated circuit 311 receives the frame data FDAT from the host processor 201, and controls the display panel 350 such that a frame image corresponding to the frame data FDAT is displayed on the display panel 350 based on the first synchronization signal ESYNC without storing the frame data FDAT. The display driver integrated circuit 311 may be implemented not to include a frame buffer that stores the frame data FDAT.

In some example embodiments, the first synchronization signal ESYNC may be transmitted from the display driver integrated circuit 311 to the host processor 201 through the first channel CH12, and the frame data FDAT may be transmitted from the host processor 201 to the display driver integrated circuit 311 through the second channel CH2 different from the first channel CH12.

Figure 14:
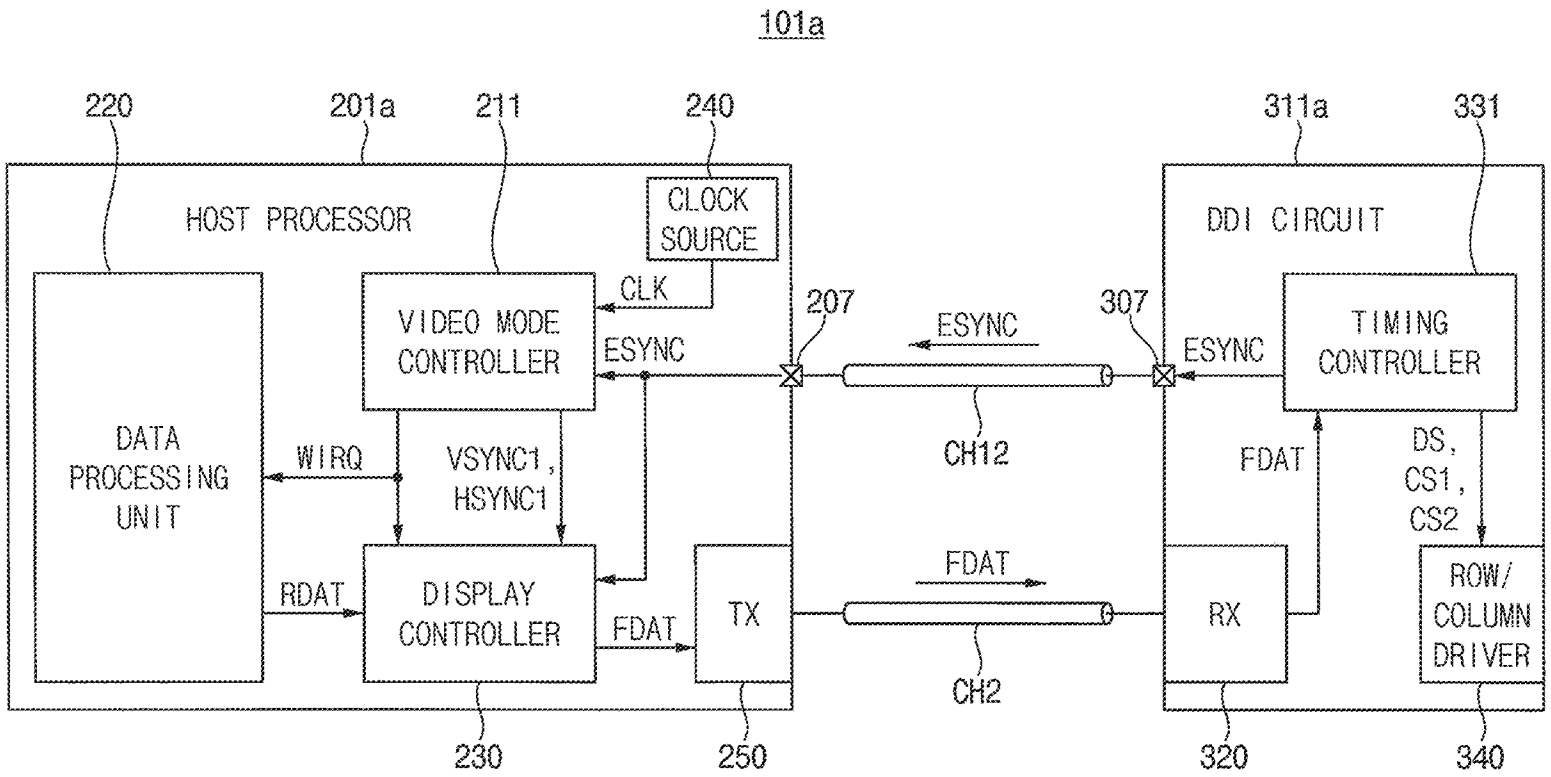
FIG. 14 is a block diagram illustrating an example of a display system of FIG. 13.

FIG. 14 is a block diagram illustrating an example of a display system of FIG. 13. The descriptions mentioned in connection with FIG. 2 will be omitted.

Referring to FIG. 14, a display system 101*a* includes a host processor 201*a* and a display driver integrated circuit 311*a*. The display system 101*a* may further include the first channel CH12 and the second channel CH2.

The host processor 201*a* may include a video mode controller 211 and a display controller 230. The host processor 200*a* may further include a first pin 207, a data processing unit 220, a clock source 240 and a transmitter 250.

The host processor 201*a* may be substantially the same as the host processor 200*a* in FIG. 2, except that the first synchronization signal ESYNC is received from the display driver integrated circuit 311*a* and operations of the video mode controller 211 and the first pin 207 are partially changed.

The video mode controller 211 may generate a wakeup interrupt WIRQ by measuring the frame update period of the display panel 350, and may generate a first vertical synchronization signal VSYNC1 and a first horizontal synchronization signal HSYNC1 based on a clock signal CLK, the first synchronization signal ESYNC and the wakeup interrupt WIRQ. The video mode controller 211 may always have an enabled state.

The first pin 207 may be connected to the first channel CH12 that receives the first synchronization signal ESYNC provided from the display driver integrated circuit 311*a*.

The display driver integrated circuit 311*a* may include a timing controller 331 and a row/column driver 340, and may not include a frame buffer. The display driver integrated circuit 311*a* may further include a second pin 307 and a receiver 320.

The display driver integrated circuit 311*a* may be substantially the same as the display driver integrated circuit 310*a* in FIG. 2, except that the display driver integrated circuit 311*a* generates the first synchronization signal ESYNC and operations of the timing controller 331 and the second pin 307 are partially changed.

The timing controller 331 may generate the first synchronization signal ESYNC, and may generate a first control signal CS1, a second control signal CS2 and a data signal DS based on the first synchronization signal ESYNC and the frame data FDAT without storing the frame data FDAT. Although not illustrated in FIG. 14, the display driver integrated circuit 311*a* may further include a clock source that generates a clock signal for generating the first synchronization signal ESYNC.

The second pin 307 may be connected to the first channel CH12 that transmits the first synchronization signal ESYNC to the host processor 201*a*.

In the display system 101*a* according to some example embodiments, the display driver integrated circuit 311*a* may be implemented not to include the frame buffer. For example, the host processor 201*a* may measure the frame update period of the display panel 350, may enable the image providing path when the frame update or panel update is desired, and may transmit a new frame to the display driver integrated circuit 311*a* based on the emission time of the display panel 350. Further, the display driver integrated circuit 311*a* may provide the first synchronization signal ESYNC through the first channel CH12, which is formed separately and/or independently from the second channel CH2 for transmitting the frame data FDAT, for the synchronization with the host processor 201*a*. Accordingly, the low frequency driving and the low power driving may be efficiently implemented.

Figure 15:
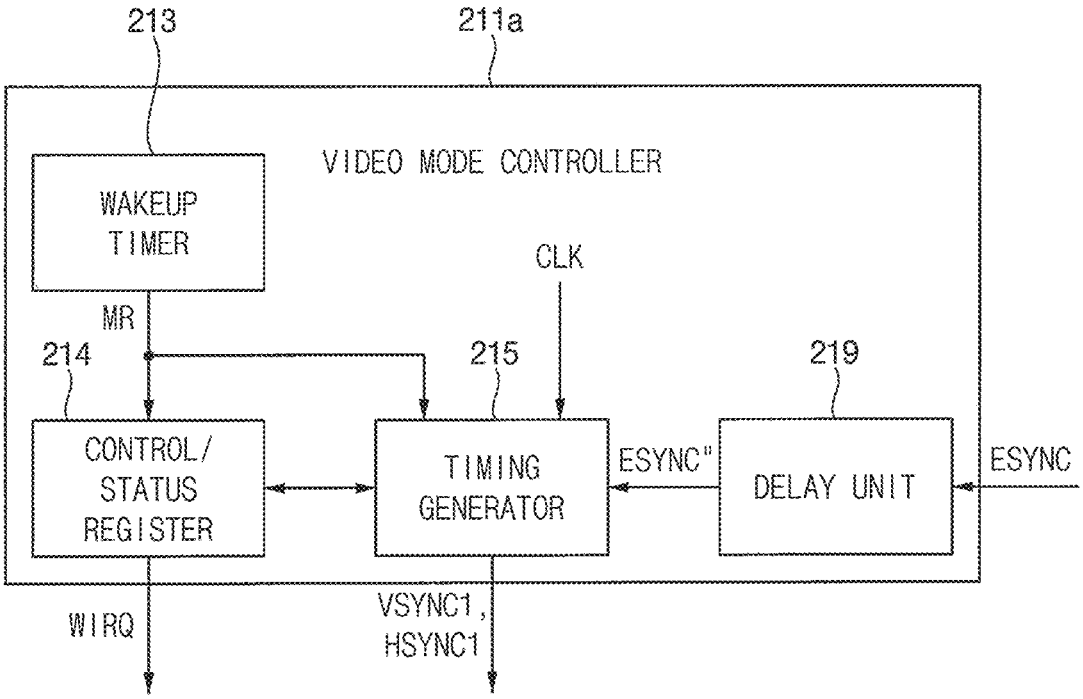
FIG. 15 is a block diagram illustrating an example of a video mode controller included in a host processor included in a display system of FIG. 14.

FIG. 15 is a block diagram illustrating an example of a video mode controller included in a host processor included in a display system of FIG. 14. The descriptions mentioned in connection with FIG. 4 will be omitted.

Referring to FIG. 15, a video mode controller 211*a* may include a wakeup timer 213, a control/status register 214 and a timing generator 215. The video mode controller 211*a* may further include a delay unit 219.

The video mode controller 211*a* may be substantially the same as the video mode controller 210*a* of FIG. 4, except that the first synchronization signal ESYNC is received from the display driver integrated circuit 311*a* and operations of the timing generator 215 and the delay unit 219 are partially changed. The wakeup timer 213 and the control/status register 214 may be substantially the same as those described with reference to FIG. 4.

The delay unit 219 may delay and provide the first synchronization signal ESYNC to the timing generator 215, and the timing generator 215 may generate the first vertical synchronization signal VSYNC1 and the first horizontal synchronization signal HSYNC1 based on the measuring result MR, the clock signal CLK, and the first synchronization signal ESYNC. For example, the delay unit 219 may delay the first synchronization signal ESYNC to generate a signal ESYNC", and the timing generator 215 may receive the signal ESYNC" as the first synchronization signal ESYNC. For example, the delay unit 219 may include a delay element for matching the skew between the first synchronization signal ESYNC received from the display driver integrated circuit 311*a* and a synchronization signal output through the serial interface from the display controller 230.

Figure 16:
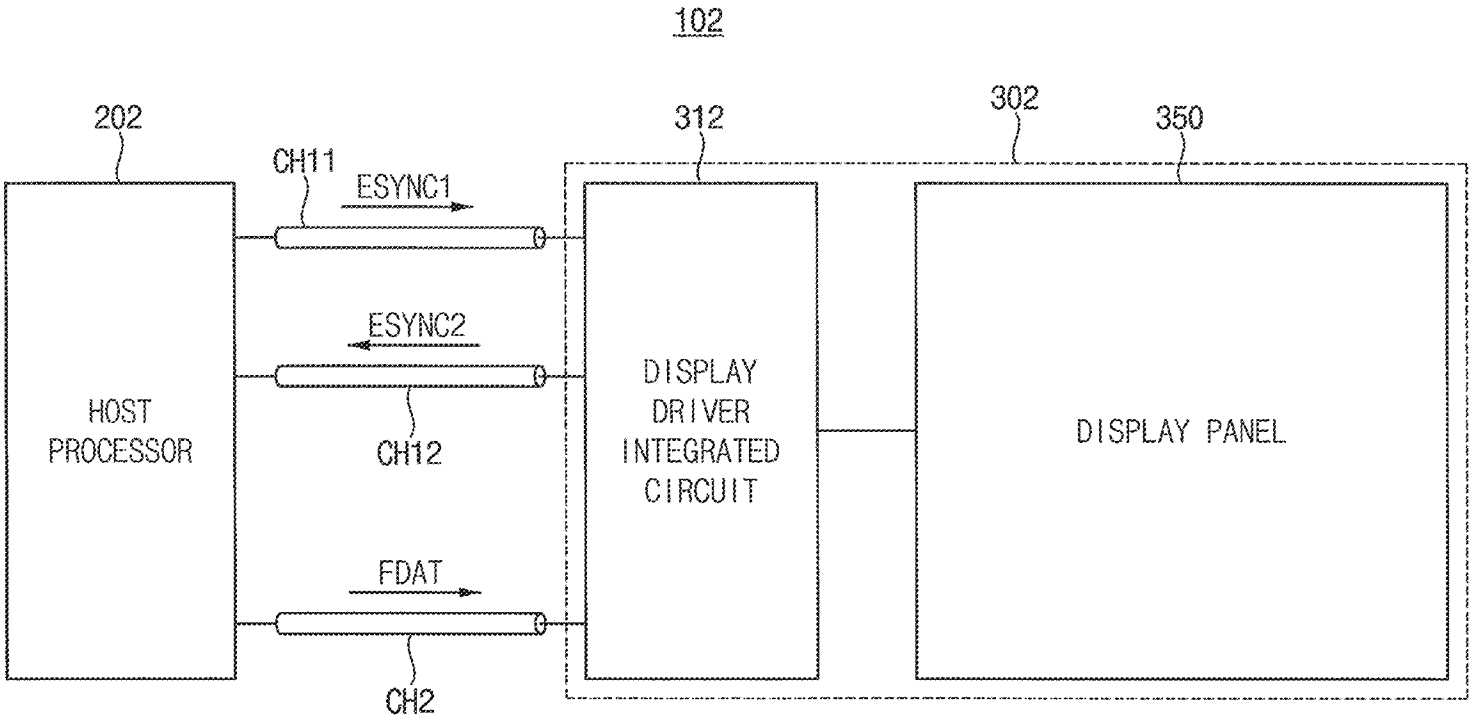
FIG. 16 is a block diagram illustrating a display system according to an example embodiment.

FIG. 16 is a block diagram illustrating a display system according to an example embodiment. The descriptions mentioned in connection with FIGS. 1 and 13 will be omitted.

Referring to FIG. 16, a display system 102 includes a host processor 202 and a display device 302. The display device 302 includes a display driver integrated circuit 312 and a display panel 350. The display system 102 may further include first channels CH11 and CH12 and a second channel CH2.

The display system 102 may be substantially the same as the display system 100 of FIG. 1, except that a synchronization signal used for the synchronization between the host processor 202 and the display driver integrated circuit 312 includes a first synchronization signal ESYNC1 generated from the host processor 202 and a second synchronization signal ESYNC2 generated from the display driver integrated circuit 312.

The first synchronization signal ESYNC1 may be substantially the same as the first synchronization signal ESYNC in FIG. 1, and an operation of generating the first synchronization signal ESYNC1 by the host processor 202 may be substantially the same as that described with reference to FIG. 1. The second synchronization signal ESYNC2 may be substantially the same as the first synchronization signal ESYNC in FIG. 13, and an operation of generating the second synchronization signal ESYNC2 by the display driver integrated circuit 312 may be substantially the same as that described with reference to FIG. 13.

In some example embodiments, the display system 102 may selectively operate in one of a first operation mode and a second operation mode. During the first operation mode, the display system 102 may generate the first synchronization signal ESYNC1 and may operate based on the first synchronization signal ESYNC1. During the second operation mode, the display system 102 may generate the second synchronization signal ESYNC2 and may operate based on the second synchronization signal ESYNC2. The first operation mode may be referred to as an AP centric mode, and the display system 102 may be implemented and operated in the first operation mode as described with reference to FIGS. 1 through 12. The second operation mode may be referred to as a DDI centric mode, and the display system 102 may be implemented and operated in the second operation mode as described with reference to FIGS. 13 through 15. For example, the first channel CH12 and the second synchronization signal ESYNC2 may be disabled or deactivated in the first operation mode, and the first channel CH11 and the first synchronization signal ESYNC1 may be disabled or deactivated in the second operation mode.

In some example embodiments, one of the first channels CH11 and CH12 may be omitted. For example, only one first channel may be used, the first synchronization signal ESYNC1 may be transmitted from the host processor 202 to the display driver integrated circuit 312 through the one first channel in the first operation mode, and the second synchronization signal ESYNC2 may be transmitted from the display driver integrated circuit 312 to the host processor 202 through the one first channel in the second operation mode.

Figure 17:
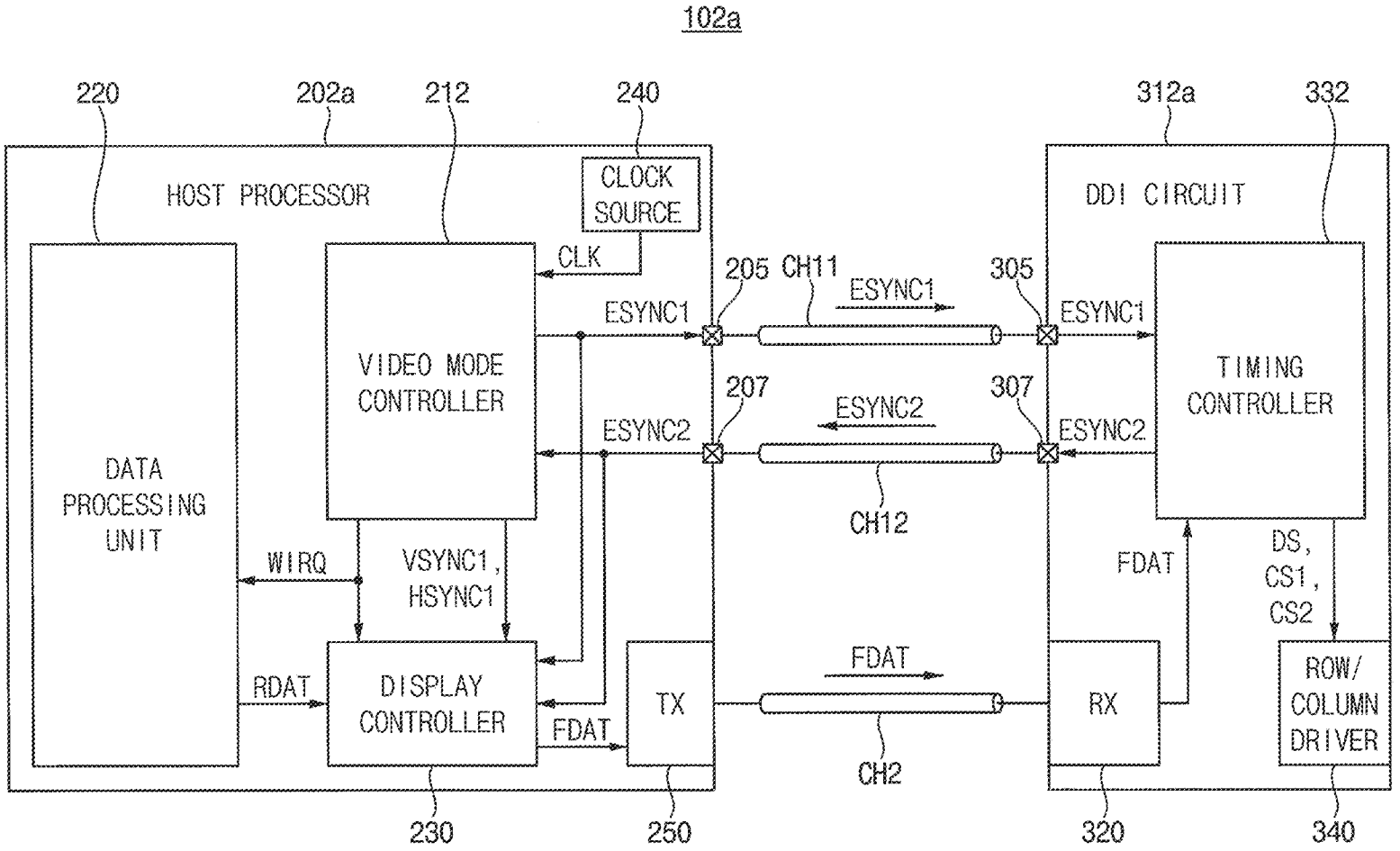
FIG. 17 is a block diagram illustrating an example of a display system of FIG. 16.

FIG. 17 is a block diagram illustrating an example of a display system of FIG. 16. The descriptions mentioned in connection with FIGS. 2 and 14 will be omitted.

Referring to FIG. 17, a display system 102*a* includes a host processor 202*a* and a display driver integrated circuit 312*a*. The display system 101*a* may further include the first channels CH11 and CH12 and the second channel CH2.

The host processor 202*a* may include a video mode controller 212 and a display controller 230. The host processor 202*a* may further include first pins 205 and 207, a data processing unit 220, a clock source 240 and a transmitter 250.

The host processor 202*a* may be substantially the same as the host processor 200*a* in FIG. 2, except that the host processor 202*a* additionally receives the second synchronization signal ESYNC2. The video mode controller 212 may operate similarly to the video mode controller 210 in FIG. 2 in the first operation mode, and may operate similarly to the video mode controller 211 in FIG. 14 in the second operation mode.

The display driver integrated circuit 312*a* may include a timing controller 332 and a row/column driver 340, and may not include a frame buffer. The display driver integrated circuit 312*a* may further include second pins 305 and 307 and a receiver 320.

The display driver integrated circuit 312*a* may be substantially the same as the display driver integrated circuit 310*a* in FIG. 2, except that the display driver integrated circuit 312*a* additionally generates the second synchronization signal ESYNC2. The timing controller 332 may operate similarly to the timing controller 330 in FIG. 2 in the first operation mode, and may operate similarly to the timing controller 331 in FIG. 14 in the second operation mode.

Figure 18:
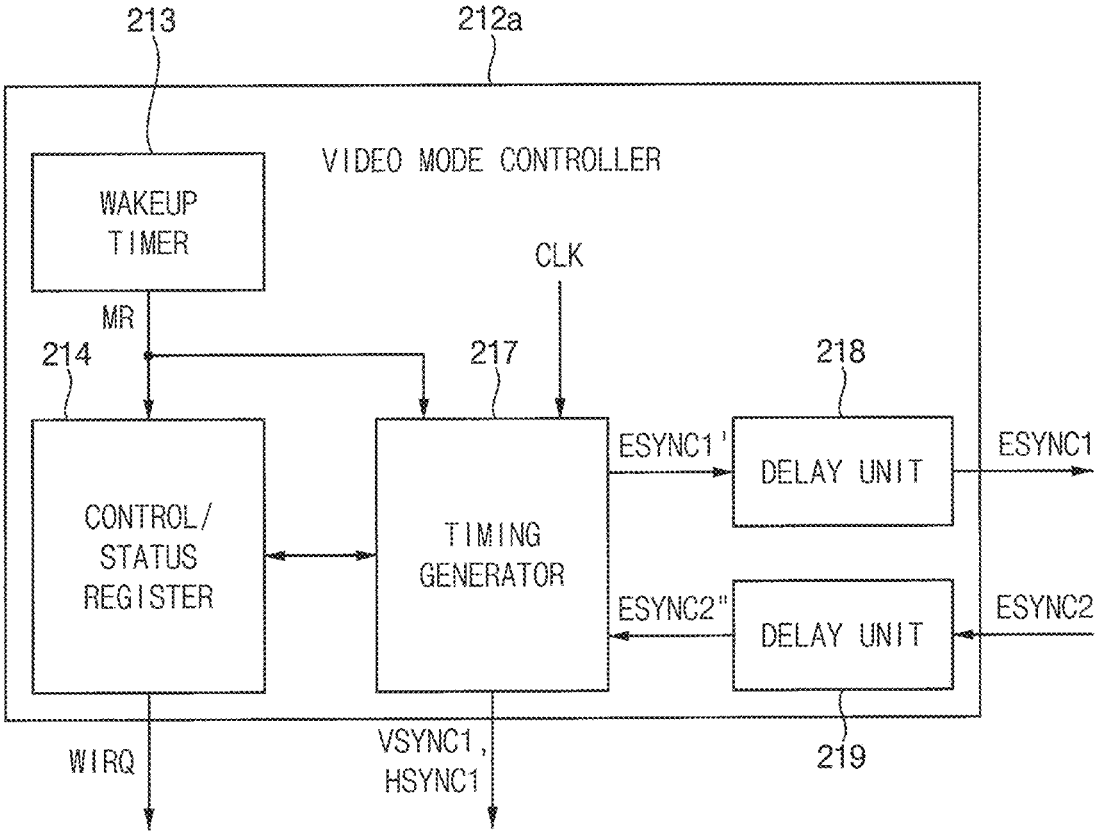
FIG. 18 is a block diagram illustrating an example of a video mode controller included in a host processor included in a display system of FIG. 17.

FIG. 18 is a block diagram illustrating an example of a video mode controller included in a host processor included in a display system of FIG. 17. The descriptions mentioned in connection with FIGS. 4 and 15 will be omitted.

Referring to FIG. 18, a video mode controller 212*a* may include a wakeup timer 213, a control/status register 214 and a timing generator 217. The video mode controller 212*a* may further include delay units 218 and 219.

The video mode controller 212*a* may be substantially the same as the video mode controller 210*a* of FIG. 4, except that the video mode controller 212*a* additionally receives the second synchronization signal ESYNC2. The timing generator 217 may operate similarly to the timing generator 216 in FIG. 4 in the first operation mode, and may operate similarly to the timing generator 215 in FIG. 15 in the second operation mode. Signals ESYNC1' and ESYNC2" may be substantially the same as the signals ESYNC' and ESYNC" in FIGS. 4 and 15, respectively.

Although not illustrated in detail, the video mode controllers 211*a* and 212*a* in FIGS. 15 and 18 may be implemented as described with reference to FIGS. 5 and 6, the display controller 230 in FIGS. 14 and 17 may be implemented as described with reference to FIGS. 7 and 8, and the display devices 301 and 302 in FIGS. 13 and 16 may operate as described with reference to FIGS. 11A, 11B, 11C, 11D, 12A, 12B, 12C and 12D.

Figure 19:
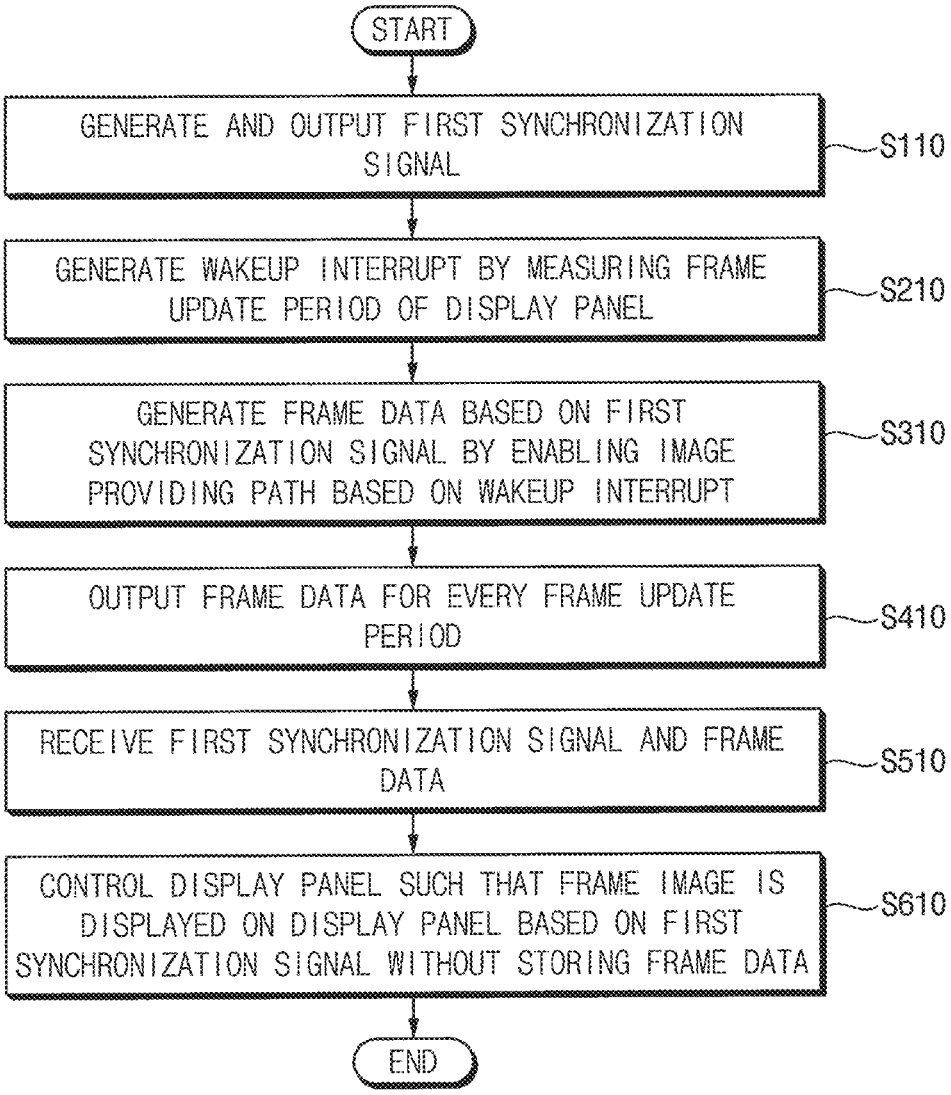
FIG. 19 is a flowchart illustrating a display control method according to an example embodiment.

FIG. 19 is a flowchart illustrating a display control method according to an example embodiment.

Referring to FIGS. 1, 2 and 19, in a display control method according to an example embodiment, a first synchronization signal ESYNC is generated and output based on a clock signal CLK (step S110). Step S110 may be performed by the host processor 200. FIG. 19 illustrates the operation in the AP centric interface (or an AP centric mode).

A wakeup interrupt WIRQ is generated by measuring a frame update period of the display panel 350 (step S210). Step S210 may be performed by the host processor 200. For example, step S210 may be performed as described with reference to FIGS. 4, 5 and 6.

Frame data FDAT is generated based on the first synchronization signal ESYNC by enabling an image providing path based on the wakeup interrupt WIRQ (step S310), and the frame data FDAT is output for every frame update period (step S410). Steps S310 and S410 may be performed by the host processor 200. Steps S310 and S410 will be described in detail with reference to FIG. 20.

The first synchronization signal ESYNC and the frame data FDAT are received (step S510), and the display panel 350 is controlled such that a frame image corresponding to the frame data FDAT is displayed on the display panel 350 based on the first synchronization signal ESYNC without storing the frame data FDAT (step S610). Steps S510 and S610 may be performed by the display driver integrated circuit 310. For example, step S610 may be performed as described with reference to FIGS. 11A, 11B, 11C, 11D, 12A, 12B, 12C and 12D.

Figure 20:
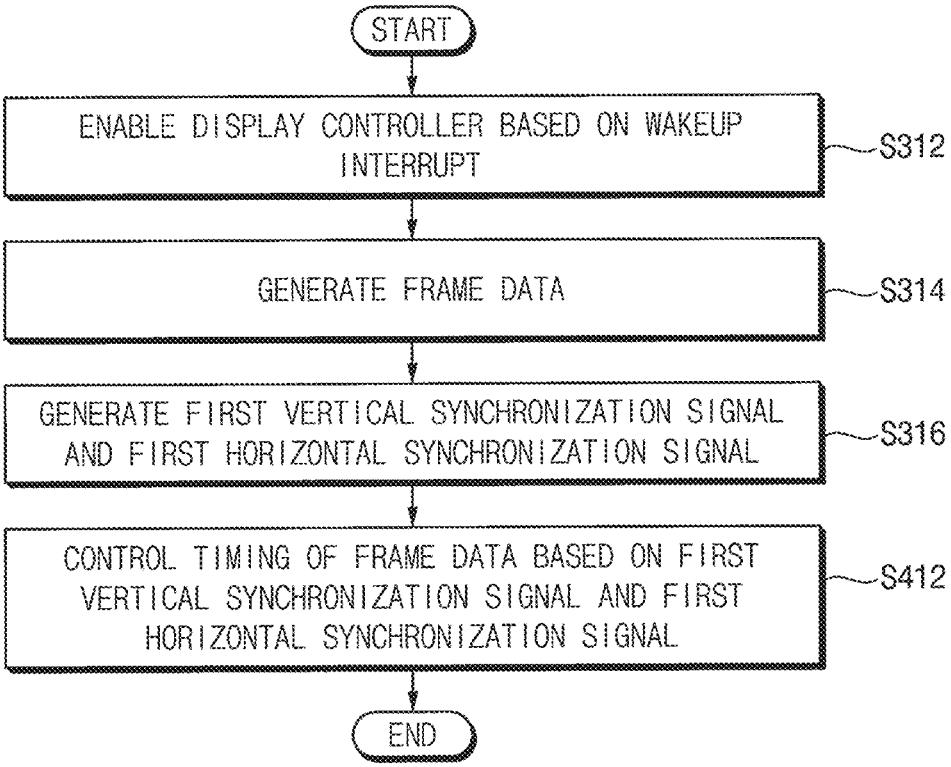
FIG. 20 is a flowchart illustrating an example of steps S310 and S410 in FIG. 19.

FIG. 20 is a flowchart illustrating an example of steps S310 and S410 in FIG. 19.

Referring to FIGS. 2, 19 and 20, in step S310, the display controller 230 may be enabled based on the wakeup interrupt WIRQ (step S312), the frame data FDAT may be generated (step S314), and a first vertical synchronization signal VSYNC1 and a first horizontal synchronization signal HSYNC1 may be generated (step S316). In step S410, a timing of the frame data FDAT may be controlled based on the first vertical synchronization signal VSYNC1 and the first horizontal synchronization signal HSYNC1 (step S412). Steps S312 and S316 may be performed by the video mode controller 210, and steps S314 and S412 may be performed by the display controller 230. For example, steps S312, S314, S316 and S412 may be performed as described with reference to FIGS. 4 through 8.

Figure 21:
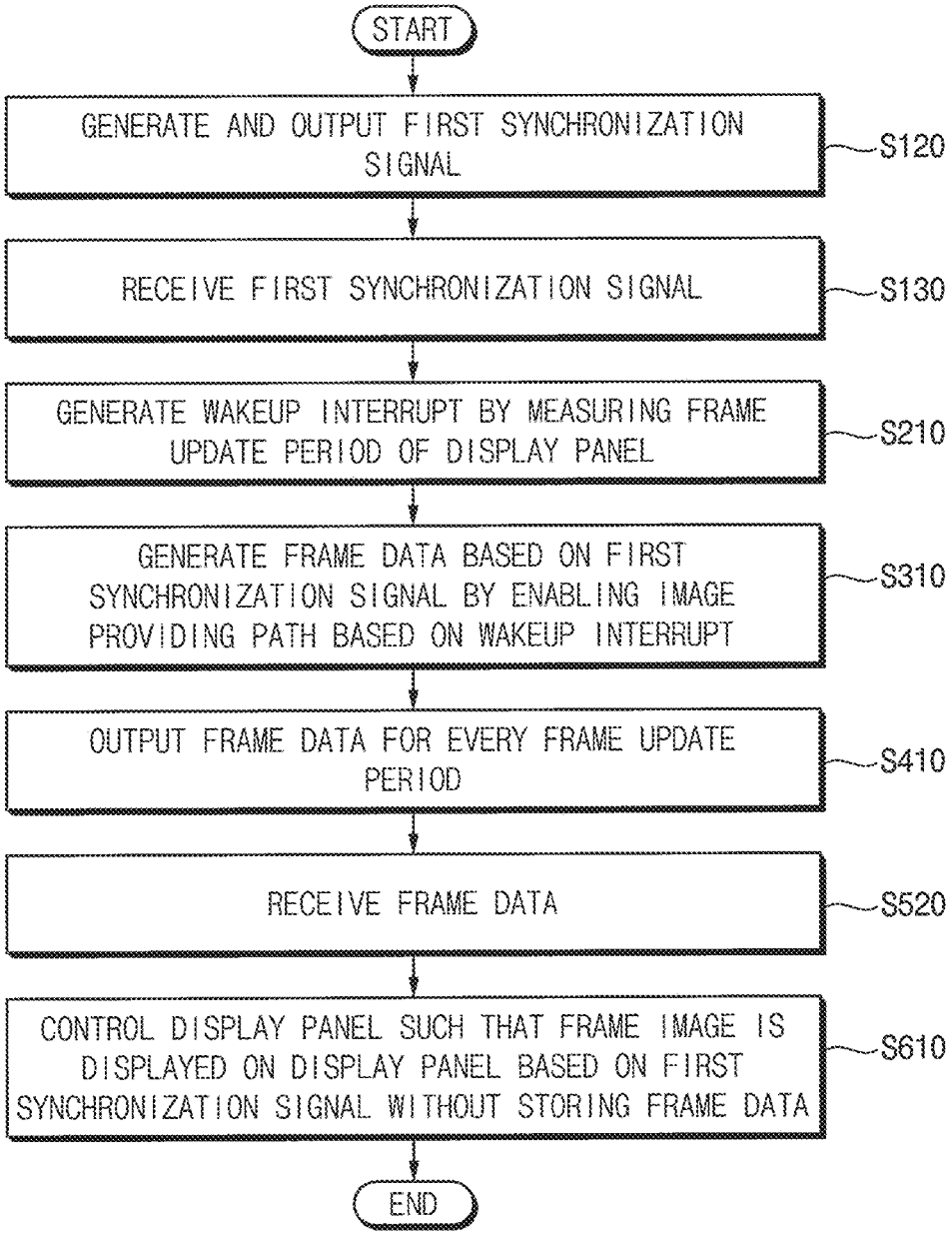
FIG. 21 is a flowchart illustrating a display control method according to an example embodiment.

FIG. 21 is a flowchart illustrating a display control method according to an example embodiment. The descriptions mentioned in connection with FIG. 19 will be omitted.

Referring to FIGS. 13 and 21, in a display control method according to an example embodiment, a first synchronization signal ESYNC is generated and output (step S120), and the first synchronization signal ESYNC is received (step S130). Step S120 may be performed by the display driver integrated circuit 311, and step S130 may be performed by the host processor 201. FIG. 21 illustrates the operation in the DDI centric interface (or a DDI centric mode).

After that, steps S210, S310 and S410 may be substantially the same as described with reference to FIG. 19. After that, the frame data FDAT is received (step S520). Step S520 may be performed by the display driver integrated circuit 311. After that, step S610 may be substantially the same as described with reference to FIG. 19.

Figure 22:
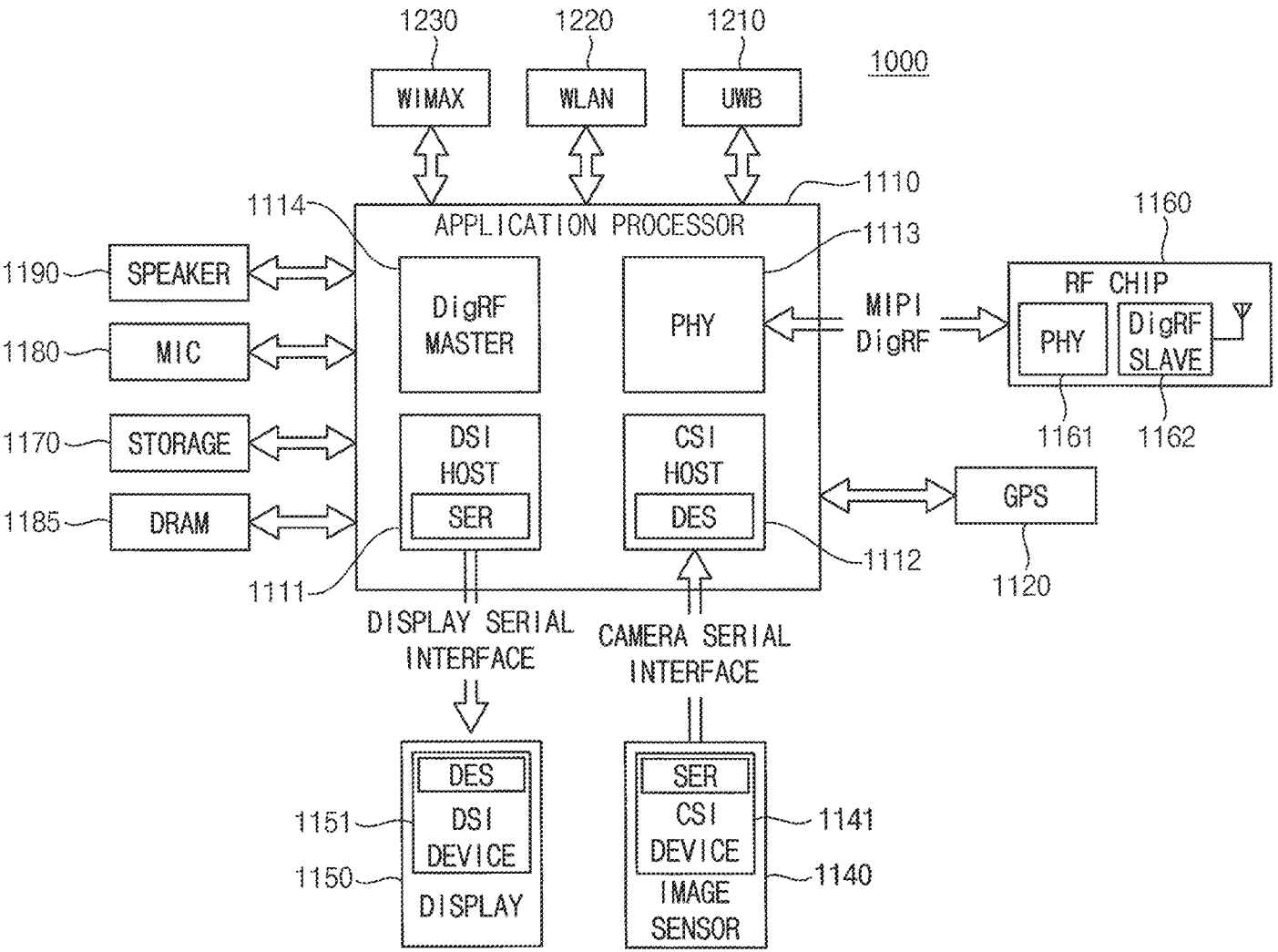
FIG. 22 is a block diagram illustrating an electronic system including a display system according to an example embodiment.

FIG. 22 is a block diagram illustrating an electronic system including a display system according to an example embodiment.

Referring to FIG. 22, an electronic system 1000 may be implemented as a data processing device that uses or supports a mobile industry processor interface (MIPI). The electronic system 1000 may include an application processor 1110, an image sensor 1140, a display device 1150, etc. The electronic system 1000 may further include a radio frequency (RF) chip 1160, a global positioning system (GPS) 1120, a storage 1170, a microphone (MIC) 1180, a dynamic random access memory (DRAM) 1185 and a speaker 1190. In addition, the electronic system 1000 may perform communications using an ultra wideband (UWB) 1210, a wireless local area network (WLAN) 1220, a worldwide interoperability for microwave access (WIMAX) 1230, etc.

The application processor 1110 may be a controller or a processor that controls operations of the image sensor 1140 and the display device 1150.

The application processor 1110 may include a display serial interface (DSI) host 1111 that performs a serial communication with a DSI device 1151 of the display device 1150, a camera serial interface (CSI) host 1112 that performs a serial communication with a CSI device 1141 of the image sensor 1140, a physical layer (PHY) 1113 that performs data communications with a PHY 1161 of the RF chip 1160 based on a MIPI DigRF, and a DigRF MASTER 1114 that controls the data communications of the physical layer 1161. A DigRF SLAVE 1162 of the RF chip 1160 may be controlled through the DigRF MASTER 1114.

In some example embodiments, the DSI host 1111 may include a serializer (SER), and the DSI device 1151 may include a deserializer (DES). In some example embodiments, the CSI host 1112 may include a deserializer (DES), and the CSI device 1141 may include a serializer (SER).

The application processor 1110 may be a host processor or an application processor according to some example embodiments, the DSI device 1151 may be a display driver integrated circuit according to some example embodiments, and the application processor 1110 and the DSI device 1151 may form the display system according to some example embodiments, and may perform the display control method according to some example embodiments.

The inventive concepts may be applied to various electronic devices and systems that include the display devices and the display systems. For example, the inventive concept may be applied to systems such as a personal computer (PC), a server computer, a data center, a workstation, a mobile phone, a smart phone, a tablet computer, a laptop computer, a personal digital assistant (PDA), a portable multimedia player (PMP), a digital camera, a portable game console, a music player, a camcorder, a video player, a navigation device, a wearable device, an internet of things (IoT) device, an internet of everything (IoE) device, an e-book reader, a virtual reality (VR) device, an augmented reality (AR) device, a robotic device, a drone, etc.

Various elements (e.g., video mode controller, data processing unit, display controller, clock source, transmitter, receiver, wakeup timer, control/status register, timing generator, delay unit, image processing unit, video timer, mode selector, global timer, row/column driver, timing controller, the scan driver, and data driver) disclosed as black boxes may be functional units of the host processor 220*a*, and may be implemented as processing circuitry such as hardware including logic circuits or a combination of hardware and software such as a processor executing software. For example, the processing circuitry may include, but is not limited to, a central processing unit (CPU), an arithmetic logic unit (ALU), a digital signal processor, a microcomputer, a field programmable gate array (FPGA), a System-on-Chip (SoC), a programmable logic unit, a microprocessor, application-specific integrated circuit (ASIC), etc.

The foregoing is illustrative of some example embodiments and is not to be construed as limiting thereof. Although some example embodiments have been described, those skilled in the art will readily appreciate that many modifications are possible in the example embodiments without materially departing from the novel teachings and advantages of the example embodiments. Accordingly, all such modifications are intended to be included within the scope of example embodiments as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display system comprising:

a host processor configured to generate a clock signal that swings periodically between a high level and a low level, generate and output a first synchronization signal based on the clock signal, generate a wakeup interrupt by measuring a frame update period of a display panel, generate frame data based on the first synchronization signal by enabling an image providing path based on the wakeup interrupt, and output the frame data for every frame update period; and a display driver integrated circuit configured to receive the first synchronization signal and the frame data from the host processor, and control the display panel such that a frame image corresponding to the frame data is displayed on the display panel based on the first synchronization signal without storing the frame data.

2. The display system of claim 1, wherein:

the first synchronization signal is transmitted from the host processor to the display driver integrated circuit through a first channel; and the frame data is transmitted from the host processor to the display driver integrated circuit through a second channel different from the first channel.

3. The display system of claim 1, wherein the host processor includes:

a clock source configured to generate the clock signal;

a video mode controller configured to generate the first synchronization signal and the wakeup interrupt, and generate a first vertical synchronization signal and a first horizontal synchronization signal based on the clock signal and the first synchronization signal and the wakeup interrupt, the video mode controller always being in an enabled state; and a display controller configured to be selectively enabled based on the wakeup interrupt, and generate and output the frame data based on the first vertical synchronization signal and the first horizontal synchronization signal.

4. The display system of claim 3, wherein:

the video mode controller is in a first power domain, and the display controller is in a second power domain different from the first power domain.

5. The display system of claim 3, wherein the video mode controller includes:

a wakeup timer configured to measure the frame update period;

a control/status register configured to generate the wakeup interrupt based on a measuring result from the wakeup timer; and a timing generator configured to generate the first synchronization signal based on the clock signal, and generate the first vertical synchronization signal and the first horizontal synchronization signal based on the measuring result, the clock signal, and the first synchronization signal.

6. The display system of claim 5, wherein the frame update period measured by the wakeup timer is associated with a retention characteristic of the display panel.

7. The display system of claim 5, wherein the host processor further includes:

a mode selector configured to set the frame update period, and wherein the wakeup timer is configured to measure the frame update period set by the mode selector.

8. The display system of claim 3, wherein the video mode controller includes:

a control/status register configured to generate the wakeup interrupt based on time information from a global timer outside the video mode controller; and a timing generator configured to generate the first synchronization signal based on the clock signal, and generate the first vertical synchronization signal and the first horizontal synchronization signal based on the time information, the clock signal, and the first synchronization signal.

9. The display system of claim 3, wherein the display controller includes:

an image processing unit configured to generate the frame data; and a video timer configured to control a timing of the frame data based on the first vertical synchronization signal and the first horizontal synchronization signal.

10. The display system of claim 3, wherein the display driver integrated circuit includes:

a timing controller configured to generate a first control signal, a second control signal and a data signal based on the first synchronization signal and the frame data without storing the frame data; and a row/column driver configured to generate a plurality of data voltages and a plurality of scan signals based on the first control signal, the second control signal, and the data signal and provide the plurality of data voltages and the plurality of scan signals to the display panel.

11. The display system of claim 10, wherein the row/column driver is configured to divide each frame interval into a plurality of sub-intervals, and start an operation of displaying the frame image in a first sub-interval that appears first after the frame data is received among the plurality of sub-intervals.

12. A display system comprising:

a display driver integrated circuit configured to control a display panel, and generate and output a first synchronization signal; and a host processor configured to receive the first synchronization signal from the display driver integrated circuit, generate a wakeup interrupt by measuring a frame update period of the display panel, generate frame data based on the first synchronization signal by enabling an image providing path based on the wakeup interrupt, and output the frame data for every frame update period, and wherein the display driver integrated circuit is configured to receive the frame data from the host processor, and control the display panel such that a frame image corresponding to the frame data is displayed on the display panel based on the first synchronization signal without storing the frame data.

13. The display system of claim 12, wherein:

the first synchronization signal is transmitted from the display driver integrated circuit to the host processor through a first channel, and the frame data is transmitted from the host processor to the display driver integrated circuit through a second channel different from the first channel.

14. The display system of claim 12, wherein the host processor includes:

a video mode controller configured to generate the wakeup interrupt, generate a first vertical synchronization signal and a first horizontal synchronization signal based on a clock signal and the first synchronization signal and the wakeup interrupt, the video mode controller always being in an enabled state; and a display controller configured to be selectively enabled based on the wakeup interrupt, and generate and output the frame data based on the first vertical synchronization signal and the first horizontal synchronization signal.

15. The display system of claim 14, wherein:

the video mode controller is in a first power domain, and the display controller is in a second power domain different from the first power domain.

16. The display system of claim 14, wherein the video mode controller includes:

a wakeup timer configured to measure the frame update period;

a control/status register configured to generate the wakeup interrupt based on a measuring result from the wakeup timer; and a timing generator configured to generate the first vertical synchronization signal and the first horizontal synchronization signal based on the clock signal, the first synchronization signal, and the measuring result.

17. The display system of claim 14, wherein the display driver integrated circuit includes:

a timing controller configured to generate the first synchronization signal, and generate a first control signal, a second control signal and a data signal based on the first synchronization signal and the frame data without storing the frame data; and a row/column driver configured to generate a plurality of data voltages and a plurality of scan signals based on the first control signal, the second control signal, and the data signal and provide the plurality of data voltages and the plurality of scan signals to the display panel.

18. The display system of claim 17, wherein the row/column driver is configured to divide each frame interval into a plurality of sub-intervals, and start an operation of displaying the frame image in a first sub-interval that appears first after the frame data is received among the plurality of sub-intervals.

19. The display system of claim 17, wherein the display driver integrated circuit further includes:

a second pin connected to a first channel configured to transmit the first synchronization signal to the host processor; and a receiver connected to a second channel configured to receive the frame data from the host processor.

20. A display system comprising:

a clock source configured to generate a clock signal that swings periodically between a high level and a low level;

a wakeup timer configured to measure a frame update period of a display panel;

a control/status register configured to generate a wakeup interrupt based on a measuring result from the wakeup timer;

a timing generator configured to generate a first synchronization signal based on the clock signal to output the first synchronization signal to a display driver integrated circuit or to receive a second synchronization signal from the display driver integrated circuit, and generate a first vertical synchronization signal and a first horizontal synchronization signal based on the measuring result, the clock signal and one of the first and second synchronization signals;

a delay unit configured to delay the first synchronization signal or the second synchronization signal;

an image processing unit configured to be enabled based on the wakeup interrupt, and generate frame data; and a video timer configured to control a timing of the frame data based on the first vertical synchronization signal and the first horizontal synchronization signal, and output the frame data, wherein the first and second synchronization signals are output or received through a first channel, and the frame data is output through a second channel different from the first channel, wherein the wakeup timer, the control/status register and the timing generator are in a first power domain that is always enabled, wherein the image processing unit and the video timer are in a second power domain that is different from the first power domain and are configured to be selectively enabled based on the wakeup interrupt, and wherein the display system is configured to selectively operate in one of a first operation mode in which the first synchronization signal is generated in the timing generator or a second operation mode in which the second synchronization signal is received from the display driver integrated circuit.

* * * * *